US005381584A

United States Patent [19]

Jyoraku et al.

[11] Patent Number: 5,381,584

[45] Date of Patent: Jan. 17, 1995

[54] VACUUM CLEANER

[75] Inventors: Fumio Jyoraku; Hisao Suka; Yoshitaro Ishii; Hisanori Toyoshima; Mitsuhisa Kawamata, all of Hitachi; Haruo Koharagi, Juuou; Kazuo Tahara, Hitachi; Tunehiro Endo, Hitachiohta; Kunio Miyashita, Hitachi; Toshiyuki Ajima, Hitachi; Takeshi Abe, Hitachi; Atusi Hosokawa, Hitachi, all of Japan

[73] Assignee: Hitachi, Ltd., Tokyo, Japan

[21] Appl. No.: 145,729

[22] Filed: Nov. 4, 1993

Related U.S. Application Data

[63] Continuation of Ser. No. 885,682, May 19, 1992, abandoned, which is a continuation of Ser. No. 595,844, Oct. 11, 1990, abandoned.

[30] Foreign Application Priority Data

| | | | |
|---|---|---|---|
| Oct. 18, 1989 | [JP] | Japan | 1-268948 |
| Feb. 3, 1990 | [JP] | Japan | 2-24689 |
| Mar. 2, 1990 | [JP] | Japan | 2-24688 |
| Mar. 16, 1990 | [JP] | Japan | 2-66632 |

[51] Int. Cl.[6] ..... A47L 9/28

[52] U.S. Cl. ..... 15/319

[58] Field of Search ..... 15/319, 339

[56] References Cited

U.S. PATENT DOCUMENTS

| | | | |
|---|---|---|---|
| 4,953,253 | 9/1990 | Fukuda et al. | 15/319 |
| 4,958,406 | 9/1990 | Toyoshima et al. | 15/319 |
| 4,977,639 | 12/1990 | Takahashi et al. | 15/319 |

FOREIGN PATENT DOCUMENTS

| | | |
|---|---|---|
| 0264728 | 4/1988 | European Pat. Off. . |
| 1223923 | 9/1989 | Japan . |
| 2016910 | 9/1979 | United Kingdom . |

*Primary Examiner*—Chris K. Moore

*Attorney, Agent, or Firm*—Antonelli, Terry, Stout & Kraus

[57] ABSTRACT

A controlling apparatus controls a suction performance of a blower motor which is installed into a cleaner main body. The controlling apparatus increases the suction performance when a suction nozzle is operated and decreases the suction performance when the suction nozzle is stopped. Corresponding to a floor use suction nozzle and a crevice use suction nozzle, at a predetermined air flow amount range, the most suitable operation control being suited to a discriminated suction nozzle can carried out automatically. Plural kinds of the suction nozzles at an actual use scope are set beforehand. When the suction nozzle is exchanged the flow amount range is changed over and selected with a respective suction nozzle. Plural kinds of the suction nozzles are selected and changed over automatically according to the dimension of a change amount of an operation condition. A brushless direct motor is used as the blower motor and has a domain being operated at a chopper control duty of factor 100%.

18 Claims, 11 Drawing Sheets

VACUUM CLEANER

This application is a continuation application of Ser. No. 07/885,682 filed May 19, 1992 and now abandon which is a continuation of application Ser. No. 07/595,844 filed Oct. 11, 1990, and now abandoned.

BACKGROUND OF THE INVENTION

The present invention relates to a vacuum cleaner adapted to exchangeably accommodate a plurality of different types of suction nozzles, with a suction performance characteristic of an electric driven blower motor being controlled in dependence upon the type of suction nozzle employed or a surface to be cleaned.

In, for example, Japanese Laid-Open No. 280831/1986, a vacuum cleaner is proposed wherein a detecting apparatus detects a change in operation conditions of the vacuum cleaner and controls the electric driven blower motor in dependence upon the detected operating conditions by a detecting apparatus. Until now, an output of the electric driven blower motor has been controlled by a detecting apparatus such as, for example, a pressure sensor or the like.

However, no consideration has been given to an operation of a suction nozzle which represents the most suitable operation characteristic control for the vacuum cleaner depending upon the surface to be cleaned.

More particularly, no consideration has been given to the fact that different types of suction nozzles are used exchangeably with a single vacuum cleaner, or that the operation characteristic for the vacuum cleaner can be affected by the air flow amount in a case wherein the filter member of the cleaner is clogged.

In this connection, the air flow range during actual use of a vacuum cleaner differs in dependence upon the type of suction nozzle used such as, for example, a suction nozzle 7 having a large opening area for general floor use and a narrow suction nozzle having a small opening area such as a crevice suction nozzle 8 as shown in FIG. 2.

In FIG. 3, graphically depicting an aerodynamic characteristic of the suction nozzle 7, a curve P1 represents an output static pressure curve of the electric driven motor, and curves A1, A2 represent the ventilating air loss pressure of the suction nozzle 7 when the filter member of the vacuum cleaner is not clogged.

As shown in FIG. 3, in the vacuum cleaner using the suction nozzle 7, the curve A1 is a lower limit value of the air flow amount or rate Q(a) with a non-clogged filter and the curve A2 is an upper limit value of the air flow amount Q(a) with a non-clogged filter. In FIG. 3, ΔH1 represents a fluctuating width in the static pressure H with the suction nozzle 7 and ΔQ1 represents a fluctuating width in the air flow amount Q(a) with the suction nozzle 7.

When the suction nozzle 7 moves on the surface to be cleaned, the contacting condition of the suction nozzle 7 with the surface to be cleaned changes and the ventilating air resistance e.g. the resistance to air being suctioned by the blower motor of the vacuum cleaner through the suction nozzle, changes and results in fluctuation of the static pressure H and the air flow amount Q between the curves A1, A2 as shown in FIG. 3

The ventilating air loss at the suction nozzle portion is reduced in accordance with the reduction of the air flow amount Q. The static pressure fluctuating width ΔH1, e.g. the amount of the static pressure fluctuation ΔH1, representing a-difference between the curves A1 and A2, and which is the fluctuating width of the ventilating air loss pressure at the suction nozzle 7 depending upon the cleaning operation, is small, and the curves A1 and A2 nearly approach one another as the static pressure fluctuating width ΔH1 approaches a small air flow range as shown in FIG. 3.

In FIG. 3, the curves B1, B2 represent the ventilating air loss pressure when the filter member of the vacuum cleaner is clogged and, as compared with the curve A1 and A2, the value of the ventilating air loss increases due to the clogging of the filter member.

As shown in FIG. 3, the curve B1 represents a lower limit value of the air flow amount Q(b) during a clogging of the filter member and the curve B2 represents an upper limit value of the air flow amount Q(b) during a clogging of the filter member.

The difference between the curves B1, B2 is the fluctuating width and also is the pressure loss fluctuating width at the suction nozzle portion corresponding to each air flow amount Q(b). Further, the air flow amount Q(b) shows the lower limit of the actual dust suction performance of the vacuum cleaner.

In actual use, the vacuum cleaner having the suction nozzle 7 has a range between an air flow amount Q(a) and the air flow amount Q(b) as shown in FIG. 4. The non-use range of the vacuum cleaner having the suction nozzle 7 is less than the air flow amount Q(b) as shown in FIG. 4.

In FIG. 4, a curve P2 indicates a suction performance characteristic during a strong operation having 100 volts for the vacuum cleaner and a curve P2 indicates a suction performance characteristic during a weak operation having 50 voltage for the vacuum cleaner, respectively.

The aerodynamic characteristic with the crevice nozzle mounted on the cleaner main body is shown in FIG. 5. When the output static pressure curve P3 of the electric driven blower motor is the same as the curve P1 of FIG. 3, since the opening area of the crevice nozzle 8 is small, the ventilating air loss pressure is large. In the vacuum cleaner using the crevice nozzle 8, as shown in FIG. 5, the curve C1 is a lower limit value of the air flow amount Q(c) during no clogging of the filter member and the curve C2 is an upper limit value of the air flow amount Q(c) during no clogging of the filter member. ΔH2 is a fluctuating width in the static pressure H due to the crevice suction nozzle 8, and ΔQ2 is a fluctuating width in the air flow amount Q(c) due to the use of the crevice nozzle 8.

Therefore, even when the filter member of the cleaner main body is not clogged, the ventilating air loss pressure is large as shown by the curve C1, and even at the maximum air flow amount condition when the crevice nozzle 8 is lifted from the cleaning portion to be cleaned, it has an air flow amount Q(c). This value is substantially equal to or above the lower limit of the air flow amount Q(b) under the actual range of the air flow amount shown in FIG. 3.

As shown in FIG. 5, a curve D1 is a lower limit value of the air flow amount Q(d) during a clogging of the filter member and a curve D2 is an upper limit value of the air flow amount Q(d) during clogging of the filter member. The actual use range of the vacuum cleaner employing the crevice nozzle 8 is a range which is between the air flow amount Q(c) and the air flow amount Q(d) as shown in FIG. 6. The non-use range of the vacuum cleaner using the crevice nozzle 8 is a range which is less than the air flow amount Q(d) as shown in FIG. 6.

The curve C2 shows the fluctuating upper limit side ventilating air loss pressure when the crevice nozzle 8 is moved on the cleaning portion to be cleaned. Since the opening area of the crevice nozzle 8 is small, the opening area of the crevice nozzle 8 adheres closely to the portion to be cleaned and, at this time, the ventilating air loss has a large value. The fluctuating widths in the curve C1 and C2 have values larger than the fluctuating widths in the curve A1 and A2 in the general floor nozzle 7.

When the filter member is clogged, the lower limit value of the air flow amount in the actual use range equals the air flow amount Q(d). At that time, the ventilating air loss pressure curve line is indicated by the curve D1, and the fluctuating upper limit side ventilating air loss pressure curve is indicated by the curve D2.

As stated above, the air flow amount range Q(a)–Q(b) is the actual use range of the suction nozzle having the large opening area as shown in the general floor nozzle 7 and differs from the air flow amount range Q(c)–Q(d) in the actual use range of the suction nozzle having the small opening area as represented by the crevice nozzle 8. Comparing the representative examples shown in FIG. 3 and FIG. 5, it is clear that the air flow amount Q(a)>the air flow amount Q(c), and the air flow amount Q(b)>the air flow amount Q(d).

The actual use range which is the above stated actual use possible air flow amount range and the non-use range which is the non-use range taking into account the lowering of the dust suction performance are shown in FIG. 4 and FIG. 6 corresponding to FIG. 3 and FIG. 5.

As shown in FIGS. 4 and 6, in the air flow amount ranges greater than the air flow amounts Q(a) and Q(c) which are out of the actual use range, and in the air flow amount ranges less than the air flow amounts Q(b) and Q(d), by decreasing of the suction performance, the an electric power saving and a noise reduction for the vacuum cleaner are attained.

So as to obtain the above stated desired suction performance, the control for the suction nozzle is carried out, as easily understood when FIG. 4 and FIG. 6 are superposed as shown in FIG. 7, by only one suction performance characteristic with which the characteristics of the two suction nozzles are compatible.

Namely, in an air flow amount range less than the air flow amount Q(b), the suction performance characteristic decreases the suction force. For the suction nozzle having the small opening area such as the crevice nozzle 8, since the control for lowering the suction force is carried out early, e.g. before the air flow amount is reduced to Q(d) the suction force may become weak during the actual use range.

Additionally, in the air flow amount range less than air flow amount Q(d), the suction performance characteristic decreases the suction force. For the suction nozzle having the large opening area such as the suction nozzle 7, a problem arises in that there may be an insufficient dust suction force.

Even with the most suitable air flow amount for the general suction nozzle 7, the ventilating air loss pressure is large for the suction nozzle 8; therefore, problems arise with respect to an overheating of the electric blower motor thereby reducing the service life thereof.

Moreover, even with the most suitable air flow amount for the suction nozzle 8, a problem arises with respect to the suction nozzle 7 due to an insufficiency in the suction air flow amount thereby lowering the suction performance.

In the above described conventional techniques, only one type of operation characteristic is taken into account with respect to the cleaning surface to be cleaned, namely, the different natures of the surface to be cleaned such as tatami, floor and carpet. Accordingly, for example, little consideration is given to the careful suction performance characteristic control suited to the respective nature of the surface to be cleaned.

The electric driven blower motor in the prior art vacuum cleaner employs a chopper control system inverter driven brushless direct motor. Such a chopper control system inverter driven brushless direct motor is disclosed in, for example, Japanese Patent Laid-Open No. 214219/1985. In this type of vacuum cleaner, a predetermined suction force is obtained in dependence upon a control of a control for the rotational speed of the brushless direct motor.

Furthermore, in the above noted vacuum cleaner employing the chopper control system inverter driven brushless direct current motor, no attention has been given to protection during the over-load operation and the high speed rotation prevention of the motor.

SUMMARY OF THE INVENTION

An object of the present invention is to provide a vacuum cleaner wherein, with various suction nozzles having a different air flow amount ranges in actual use, wherein using various suction nozzles having different air flow requirements the most efficient suction performance can be attained.

Another object of the present invention is to provide a vacuum cleaner wherein an electric power saving and a low noise structure for a vacuum cleaner during a non-cleaning condition can be obtained.

A further object of the present invention is to provide a vacuum cleaner wherein the most suitable operation suction performance control suitable for a respective discriminated suction nozzle can be carried out automatically.

A further object of the present invention is to provide a vacuum cleaner wherein the nature of a cleaning portion to be cleaned can be automatically discriminated e.g. determined, according to a controlling apparatus for controlling the suction performance.

Another object of the present invention is to provide a vacuum cleaner wherein a suction performance corresponding to a respective cleaning portion to be cleaned can be improved.

Yet another object of the present invention is to provide a vacuum cleaner wherein the most suitable suction performance can be preset.

A still further object of the present invention is to provide a vacuum cleaner wherein a careful control can be carried out according to a suction performance characteristic corresponding to a respective cleaning surface to be cleaned.

A further object of the present invention is to provide a vacuum cleaner having a chopper control system inverter driven brushless direct motor wherein an over load operation can be easily prevented.

Another object of the present invention is to provide a vacuum cleaner having a chopper control system inverter driven brushless direct motor wherein a high speed rotation due to an abnormal rotation command can be prevented.

In accordance with the present invention, a vacuum cleaner comprises a plurality of different types of suction nozzles which may be selectively used with the cleaner, a detecting apparatus for detecting changing factors which fluctuate according to an operation of a selected suction nozzle of said plurality of different types of suction nozzles, with the changing factors being, for example, a static pressure, an air flow amount and an electric current, etc., and a controlling apparatus for controlling a suction performance characteristic of an electric driven blower motor of the vacuum cleaner in dependance upon the type of suction nozzle employed corresponding to a detected value of the detecting apparatus.

When the suction nozzle is operated, the controlling apparatus increases the suction performance, and when the operation of the suction nozzle is stopped, the controlling apparatus decreases the suction performance.

The first lower limit value of the air flow amount range at actual use is set and the second lower limit value is set to be at an air flow amount less than the first lower limit value. At the air flow amount range less than the first limit value, the suction performance is decreased.

At the air flow amount range between the first and second lower limit values, with a load fluctuation, it can control the suction performance within a predetermined level, and when no load fluctuation occurs, it maintains the low level suction performance.

When changes in the static pressure, the air flow amount and the electric current, which fluctuate according to the operation of the suction nozzle, are detected, and there is a fluctuation more than a predetermined amount in a predetermined period, it is possible to judge whether or not the cleaner is under the cleaning condition according to the operation of the suction nozzle.

Therefore, by increasing the suction performance by a predetermined amount, the necessary suction force for a cleaning operation can be obtained. Further, when the load fluctuation is not detected during the predetermined period, the suction performance can be decreased by a predetermined amount, and, accordingly, the electric power consumption can be reduced and a low noise level for the vacuum cleaner can be attained.

According to the present invention, during the non-cleaning condition in which the suction nozzle is not operated, the suction performance property is lowered and the electric power consumption and the low noise level for the vacuum cleaner can be obtained.

In accordance with the detection of the load fluctuation by operating the suction nozzle, the suction performance characteristic property is automatically improved and therefore the suction performance characteristic property suitable to the cleaning operation can be obtained. It is possible to control automatically the suction performance characteristic property corresponding to the frequency of an operation number of the suction nozzle.

Within only the predetermined air flow amount range corresponding to the suction nozzle having the large opening area and the suction nozzle having the small opening area, and when the suction nozzle having the small opening area in which the load fluctuation is large, by the operation of the suction nozzle mounted on and operated, it is possible to automatically increase the suction performance characteristic property. Accordingly, the most suitable operation control for the selected suction nozzle can be automatically obtained.

In accordance with the present invention, in a vacuum cleaner usable with a plurality of exchangeable suction nozzles in which air flow amount ranges in an actual use of the suction nozzles are preset, a controlling apparatus is provided for changing over and selecting an air flow amount range suitable for the respective suction nozzles upon a changing of the suction nozzles. When the plural types of suction nozzles are used exchangeably, an air flow amount range is greater than the upper limit of the air flow amount under the use of the respective suction nozzle in the non-cleaning condition in which the suction nozzle is lifted from the cleaning surface. In such a case, the electric power consumption is reduced and a noise reduction for the vacuum cleaner can be attained by lowering an output of the electric driven blower motor.

Further, when plural types of suction nozzles are used exchangeably, an air flow amount range less than the lower limit of the air flow amount under the use of the respective suction nozzle is within a range in which the dust suction ability is insufficient. In such a case, by lowering an output of the electric driven blower motor, the operator can notice that the filter member reaches a clogging stage and, at the same time, the electric power consumption can be reduced and the noise reduction for the vacuum cleaner can be attained by lowering the output of the electric driven blower motor.

In addition to the above, even when a thin material such as, for example, a curtain adheres to the suction nozzle, the absorption and release can be carried out easily by lowering the output of the electric driven blower motor.

In accordance with the present invention, a vacuum cleaner comprises an electric driven blower motor, a detecting apparatus for detecting a change of an operation condition of the vacuum cleaner, and a controlling apparatus for controlling the electric driven blower motor according to a detected value of the detecting apparatus.

The vacuum cleaner comprises a means for selecting and automatically changing a plurality of suction performance characteristic properties according to an amount of change of the operation condition by having the plurality of suction performance characteristic properties of the vacuum cleaner representing by a vacuum degree and an air flow amount and further by detecting a change of an operation condition of the vacuum cleaner in accordance with a load fluctuation of the suction nozzle of the vacuum cleaner which moves reciprocatively on a surface to be cleaned.

By presetting the operation suction performance, it is possible to automatically detect the most suitable operation characteristic property for the respective surface to be cleaned. Further, in accordance with the detected result, the automatic control operation is carried out.

Therefore, the careful control operation can be carried out with the suction characteristic property corresponding to the respective nature of the cleaning portion to be cleaned. Accordingly, the suction characteristic property in the vacuum cleaner can be improved in comparison with the conventional vacuum cleaner in which only one type of the operation characteristic property is considered regardless of the nature of the surface to be cleaned.

According to the present invention, when cleaning various cleaning surfaces of different natures, a change of an operational condition of the vacuum cleaner is detected in dependence upon a load fluctuation of the suction nozzle of the vacuum cleaner, and the respective surface to be cleaned is automatically discriminated.

In accordance with the present invention, the vacuum cleaner includes a brushless direct current motor with a rotational speed of the motor being controlled by a chopper control system inverter apparatus, and with the motor being provided in a cleaner main body. The brushless direct current motor has an operative area of a chopper control duty of a factor of 100%.

The brushless direct current motor is a synchronous motor having permanent magnets, and an inverter apparatus controls a rotational speed of the motor by changing a duty factor so as to bring the rotational speed into a load condition.

When the load is large and the duty factor is at 100%, and when the rotational speed does not increase to a desired rotational speed, the brushless direct current motor is rotated-at a rotational speed balanced with respect to a load torque.

The construction of the brushless direct current motor is determined so as to set the counter-electromotive voltage generated in an armature winding to be equal to a power source voltage. Therefore, at the load condition more than above stated, only the rotational speed is reduced, and there is no excessive increase in the input power.

Namely, the electric current increases at an amount suitable for a reduction of the counter-electromotive voltage of the lower rotational speed, and this increase in the input power is limited to a predetermined amount.

Accordingly, as in the non-cleaning condition, even when the load becomes large due to a large air flow amount into the electric driven blower motor, it is possible to prevent a substantial increase in the input power.

Furthermore, when a high speed rotational command is outputted due to an abnormality in the controlling apparatus, it is possible to automatically prevent the rotational speed from increasing above a predetermined rotational speed.

According to the present invention, in the vacuum cleaner employing the chopper controlling system inverter driven brushless direct current motor, without the special protecting apparatus, the over-load operation can be easily prevented and, the high rotational speed due to an abnormality caused by the outputted rotational speed command in the controlling apparatus can be prevented.

Since the above stated over-load prevention control is to avoid the over-load operation in dependence upon control processing programs, it is very useful, as a safety feature, even upon a malfunctioning of the microcomputer.

Further, at the vicinity of the tolerance input power upper limit value when the load is large, the chopper control duty factor becomes almost 100%. Then the chopper control does not work or may work a little, and the higher harmonic component caused by the intermittence is small, therefore the system efficiency including the inverter apparatus and the brushless direct current motor can be realized under the best condition. Namely, the high efficiency for the vacuum cleaner can be obtained at the high load side and, for example, an increase in the thermal generation can be reduced.

BRIEF DESCRIPTION OF THE DRAWINGS

FIG. 7 is a graphical illustration of an aerodynamic suction performance characteristic property showing a relationship between an output characteristic property of an electric blower motor and a load characteristic property of a general floor suction nozzle and a crevice suction nozzle in which FIGS. 4 and 6 are superposed;

DESCRIPTION OF THE INVENTION

Figure 1:
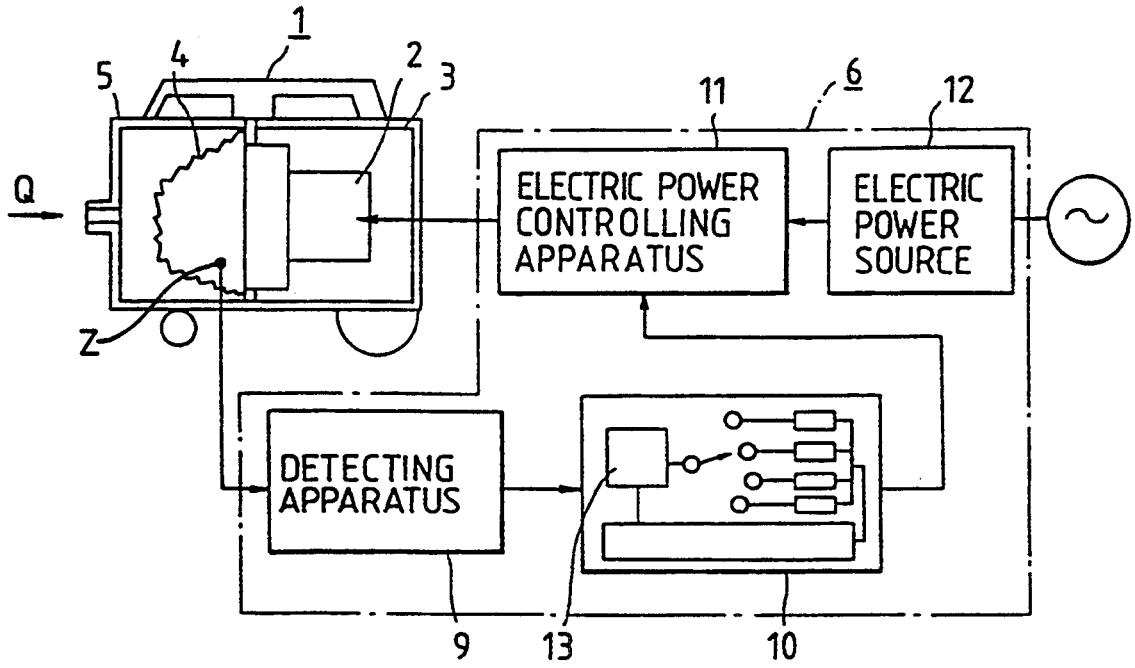
FIG. 1 is a block diagram showing one embodiment of a vacuum cleaner and controlling apparatus according to the present invention.
Figure 2:
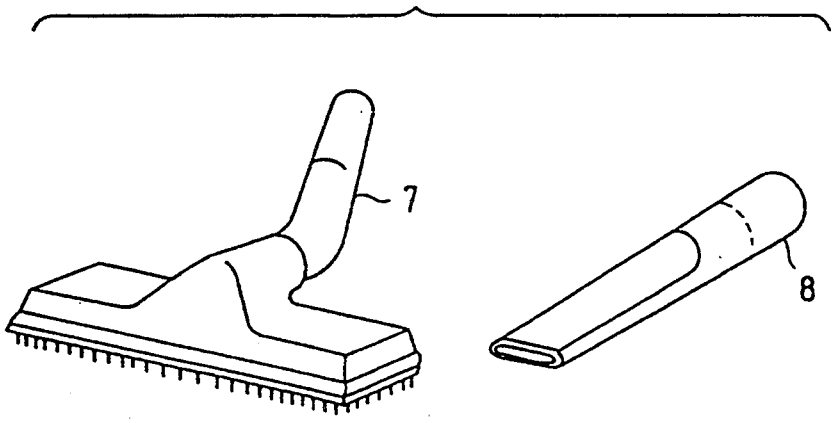
FIG. 2 is an exploded perspective view of a general floor suction nozzle and a crevice suction nozzle.

FIG. 1 is a block diagram showing a structure of a vacuum cleaner 1 and a controlling apparatus 6 thereof. The vacuum cleaner 1 comprises mainly an electric driven blower motor 2, a cleaner main body 3, a filter member 4 for filtering dust and a dust collecting case 5. The controlling apparatus 6, illustrated for the sake of clarity at an outside portion of the cleaner main body 3, is, in actuality, received in the cleaner main body 3 and is fashioned as a circuit base member or micro-computer software for performing the functions described herein The controlling apparatus 6 is composed of an executing and processing apparatus 10 for executing and processing a detected value of a detecting apparatus 9 and outputting a commanding value to an electric power controlling apparatus 11, and an electric power source 12 for supplying electric power to each of the above stated apparatuses. The executing and processing apparatus 10 includes a suction nozzle discriminating apparatus 13.

The detecting apparatus 9 detects factors of the electric driven blower motor 2 by, for example, an air flow amount e.g. rate, sensor, a static pressure sensor, an electric current sensor and a rotational speed sensor. As discussed hereinafter, the air flow amount sensor detects the suction air flow amount of the blower motor 2 in the vacuum cleaner 1 as shown schematically at point in Z in FIG. 1. The pressure sensor detects the vacuum degree or vacuum static pressure of the interior portion of the vacuum cleaner as shown schematically at point Z in FIG. 1. The factors are changed according to an operating condition of the vacuum cleaner 1. The detecting apparatus 9 directly outputs, as a detected amount, an air flow amount or, as a combination of the detected amounts, and indirectly detects an air flow amount through the executing and processing apparatus 10.

The discriminating apparatus 13 for the suction nozzle etc. is included in the executing and processing apparatus 10. The discriminating apparatus 13 discriminates a fluctuating width of the above stated changing factors or an interval of a fluctuating time, etc., and further discriminates the type of suction nozzle being mounted on the cleaner main body 3.

Figure 3:
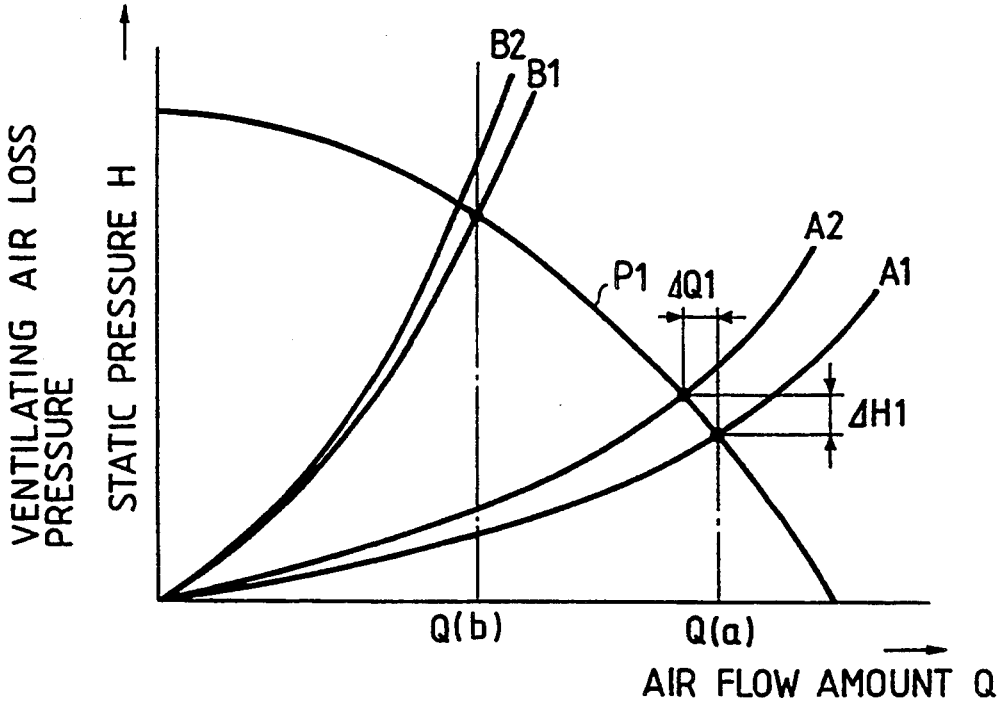
FIGS. 3 and 4 are graphical illustrations of an aerodynamic suction performance characteristic property showing a relationship between an output characteristic property of an electric driven blower motor and a load characteristic property of a general floor suction nozzle.
Figure 4:
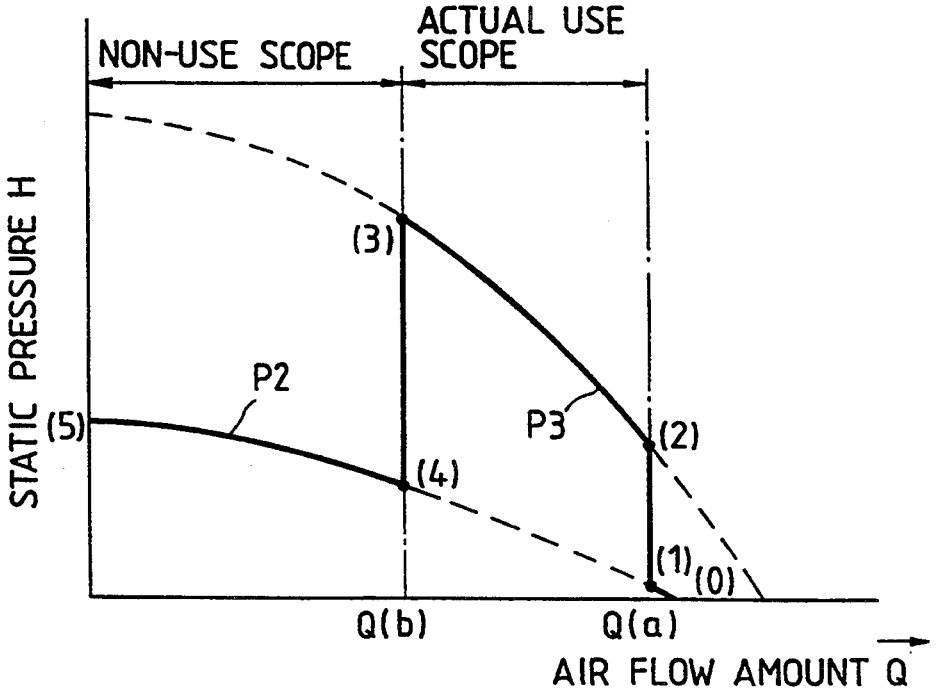
Figure 5:
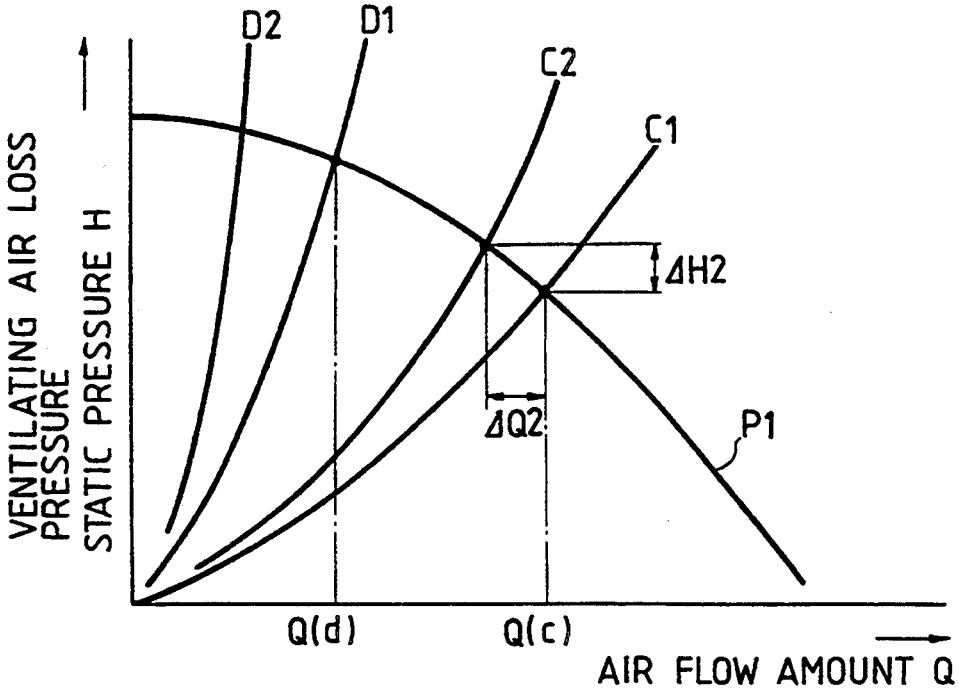
FIGS. 5 and 6 are graphical illustrations of an aerodynamic suction performance characteristic property showing a relationship between an output characteristic property of an electric driven blower motor and a load characteristic property of a crevice suction nozzle.
Figure 6:
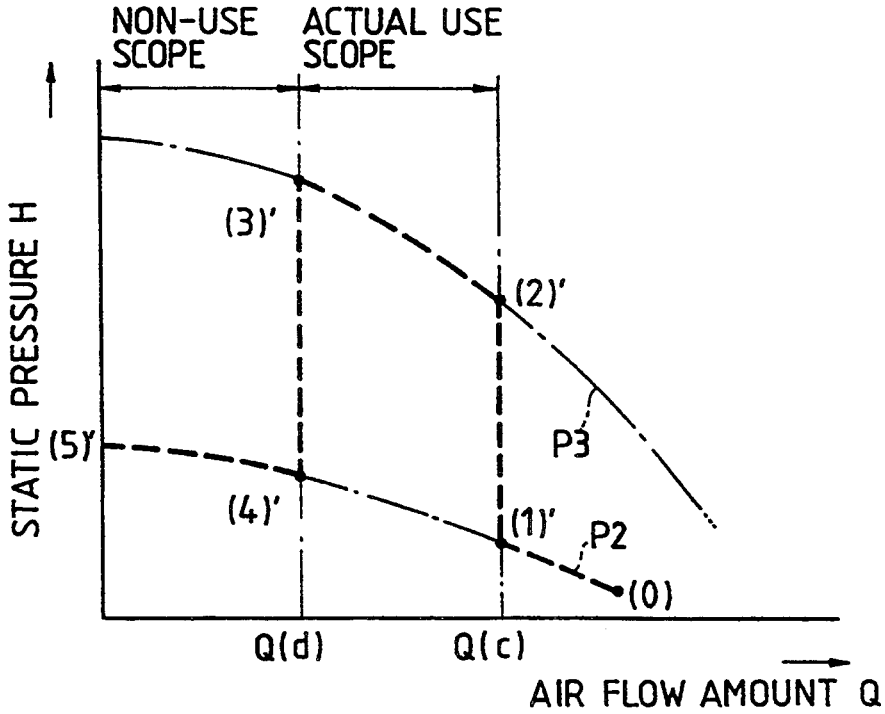
Figure 7:
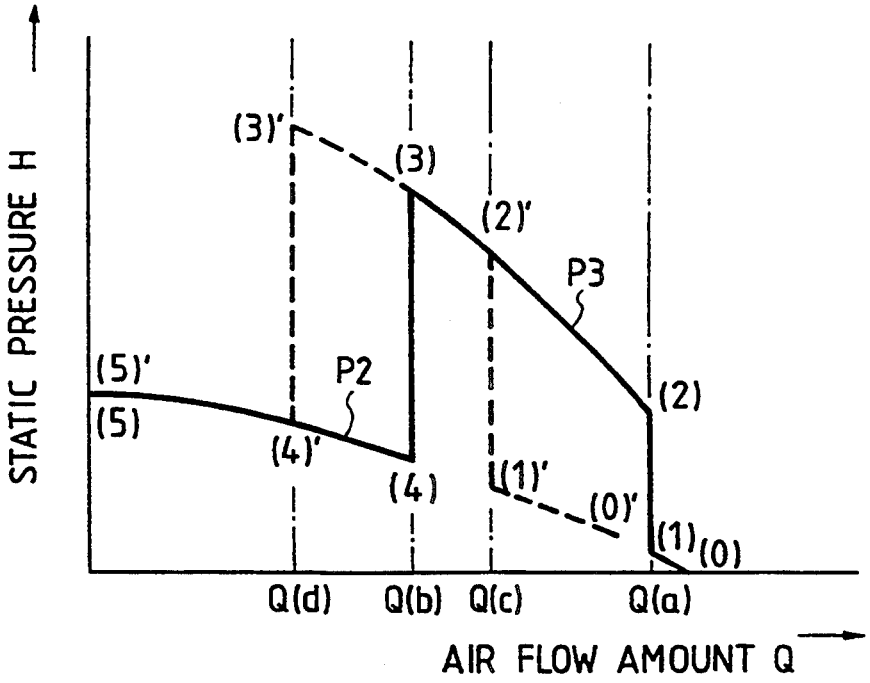

Namely, as noted hereinabove in connection with FIG. 3 and FIG. 4, the discrimination of the fluctuating widths $\Delta H1$ or $\Delta Q1$ due to the operation of the suction nozzle 7 in the static pressure H or the air flow amount Q is described more fully hereinbelow.

In the suction nozzle 7, the fluctuating width is small. However, in the crevice nozzle 8 the fluctuating widths are large. Therefore, it is possible to discriminate the type of the suction nozzle employed using a predetermined judging value. Namely, when the changing or fluctuating amount exceeds the predetermined judging value, it can judge whether or not the suction nozzle having the small opening area such as the crevice nozzle 8 is operated. This function may be constituted by electronic circuits; however, it is more suitable to employ control software in the micro-computer of the executing and processing apparatus 10. A flow chart of steps for this are shown, for example, in FIG. 15 as discussed hereinafter.

An example in which the suction performance characteristic is controlled by the above stated construction will be explained with reference to a two-dots chain curve of FIG. 8.

Namely, a first lower limit value of the air flow amount range in the actual use is set as an air flow amount Q(b) and a second lower limit value is set at an air flow amount Q(d), respectively. If the air flow amount range is lower than the air flow amount range Q(b), it is controlled at the low suction performance characteristic indicated by the curve P2, and operates at a high suction performance characteristic indicated by the curve P3 at air flow greater than Q(b) up to the amount Q(a). Above Q(a) the air flow amount is decreased to the curve P2. Thus, the combined characteristic extends through a route (0)→(1)→(2)→(3)→(4)→(5). This control assumes the use of the nozzle 7 on the cleaner and sets the characteristic appropriate therefor.

Herein, when the vacuum cleaner is operated at the air flow amount range between the air flow amount Q(b) and the air flow amount Q(d), by counting the number of fluctuations, in which the fluctuating width of the detected value according to the detecting apparatus 9 is more than the predetermined judging value, and the number of fluctuations at every predetermined period exists within a range of a predetermined number, it is possible to discriminate that the crevice nozzle 8 is mounted on the cleaner main body 3 and further discriminate that the crevice nozzle 8 is operated in the actual use condition.

By the electric signal of the discriminating apparatus 13 having the above stated function, the vacuum cleaner 1 is commanded and controlled so as to increase the predetermined suction performance characteristic by the executing and processing apparatus 10. Thereby, the vacuum cleaner 1 can operate at the low suction performance characteristic indicated by the curve P4 (the route (6)-(7)-(8)) which is indicated by the two-dots chain curve and is suitable for the crevice nozzle 8.

When the fluctuation is not greater than the judging value in the predetermined period, it is the condition under non-cleaning when the suction nozzle is not operated or it is in a non-cleaning condition of the general nozzle 7. In the latter case, it makes the condition of the low suction performance characteristic indicated by the curve P2 (the route (4)-(5)) and then it is possible to carry out an electric power reduction and a low noise operation for the vacuum cleaner 1.

As stated above, by detecting the load fluctuating width, the number of fluctuations in the predetermined period and the air flow amount, it is possible to automatically realize the most suitable suction performance characteristic for the suction nozzle mounted on the vacuum cleaner.

Another embodiment for an increase and decrease control for the suction performance characteristic will be explained in connection with FIGS. 9-12B. Comparing FIG. 9 and FIG. 10A and FIG. 10B, FIGS. 10A and 10B show an example in which the operation time is shown in the horizontal axis and then the detected value of the load fluctuation is detected according to the change of the static pressure (FIG. 10A) or the rotational speed (FIG. 10B).

Figure 9:
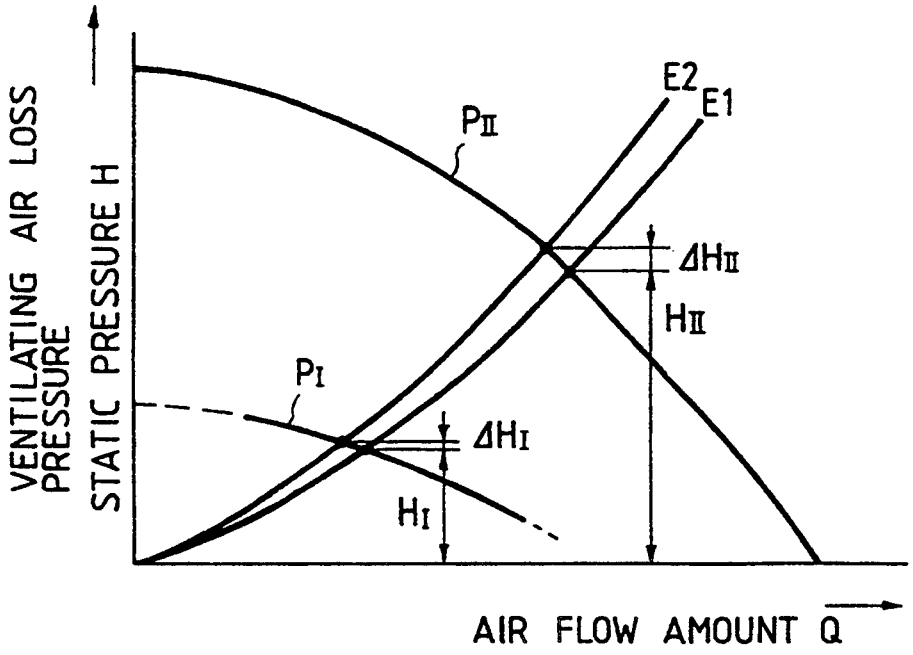
FIG. 9 is a graphical illustration of an aerodynamic suction performance characteristic property showing a relationship between an output characteristic property of an electric driven blower motor and a load characteristic property of one embodiment of a suction performance characteristic control according to the present invention.

In FIG. 9, curves $P_I$ and $P_{II}$ are output suction performance characteristics and curves E1 and E2 are ventilating air loss pressure characteristics, respectively.

Figure 10A:
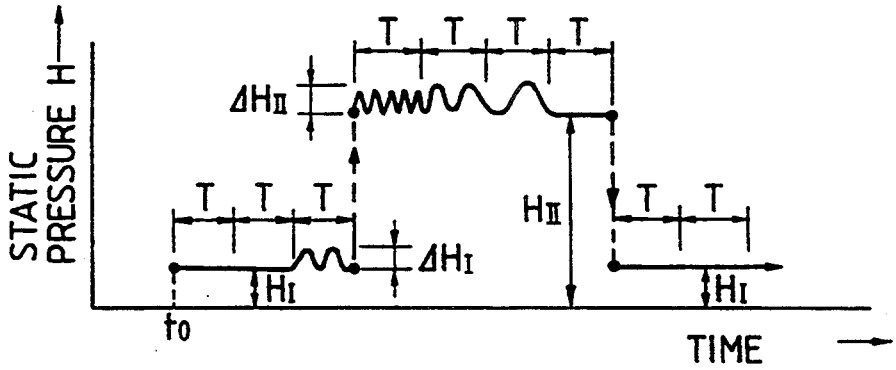
FIG. 10A is a graphical illustration showing a relationship between a static pressure of an electric driven blower motor and a cleaning time of one embodiment of a suction performance characteristic control according to the present invention.
Figure 10B:
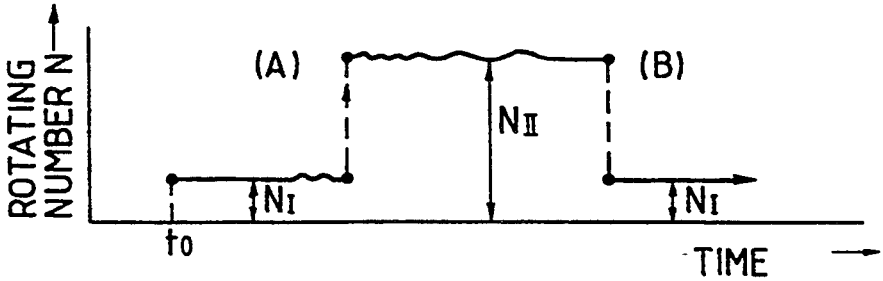
FIG. 10B is a graphical illustration showing a relationship between a rotational speed of an electric driven blower motor and a cleaning time of one embodiment of a suction performance characteristic control according to the present invention.

In FIG. 10A and FIG. 10B, when there is no change in static pressure $\Delta H$ from the load fluctuation during the predetermined period T, the suction performance characteristic is maintained at the static pressure $H_I$ in which the rotational speed N of the electric driven blower motor 2 has a rotational speed $N_I$. At every detecting period T, when more than one of the fluctuating widths $\Delta H_I$ exceeding the predetermined judging value is counted, as shown in portion (A) in FIG. 10B, the blower motor is operated at the rotational speed $N_{II}$ and the static pressure, rises to the condition of $H_{II}$, so as to become a high suction performance characteristic.

From this condition, when the fluctuating width $\Delta H_{II}$ is not counted, as shown at portion (B) in FIG. 10B, the rotational speed is returned to the original rotational speed $N_I$ and the vacuum cleaner is operated under a low suction performance characteristic.

The above stated control is controlled as the basic control for the vacuum cleaner 1. The change-over of the rotational speed N of the electric drive blower motor 2 indicated in the portions (A) and (B) in FIG. 10B is frequently repeated at every detected predetermined period T by the existence of the fluctuation. Accordingly, the rapid change of the suction performance is repeated at a short time period. Since beat sounds and vibration of the vacuum cleaner 1 may be generated, it is possible to control the vacuum cleaner to slow the reaction of the suction performance characteristic when a detected predetermined period T having no load fluctuation continues for n times periods ($n \times T$).

Figure 11:
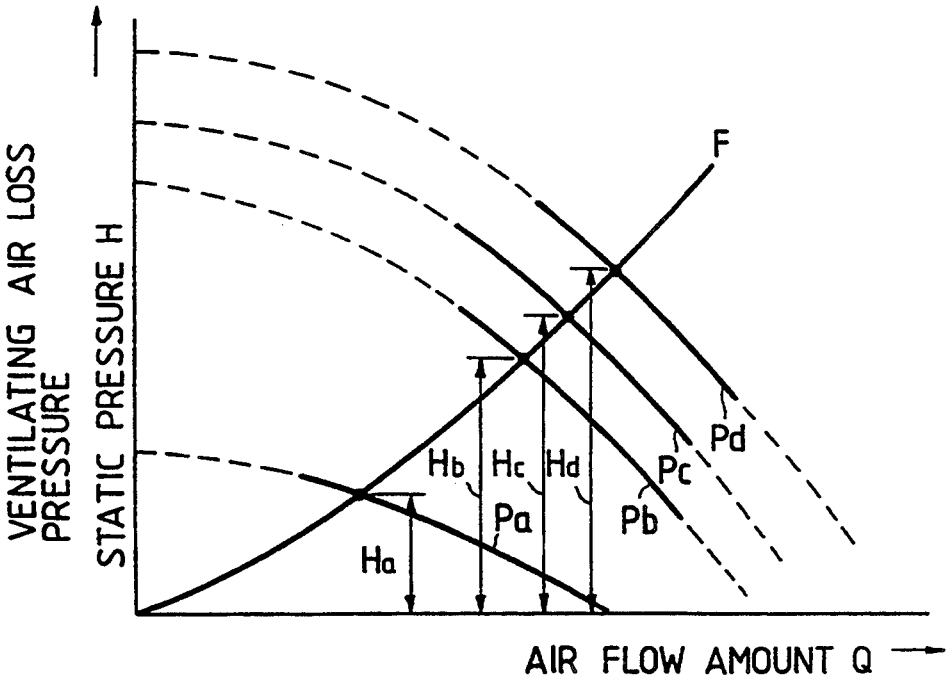
FIG. 11 is a graphical illustration of an aerodynamic suction performance characteristic showing a relationship between an output characteristic property of an electric driven blower motor and a load characteristic property of another embodiment of a suction performance characteristic control according to the present invention.

In FIG. 11, curves Pa, Pb, Pc and Pd are output suction performance characteristic and a curve F is a ventilating air loss pressure characteristic. Further, shown in FIG. 11, FIG. 12A and FIG. 12B, the vacuum cleaner 1 is operated by charging blower speed to increase or decrease the amount of the suction performance to a value which is proportional to the number of fluctuations of the static pressure H caused by the operation of the suction nozzle during the predetermined detecting period T.

On the other hand, the vacuum cleaner 1 is operated to increase or to decrease the amount of the suction performance when such a change is indicated based on the number of fluctuations of the static pressure H by the operation of the suction nozzle detected during each predetermined detecting period T.

At this time, the static pressure value Ha of the early time low level suction performance characteristic is set as a setting value in the case in which the static pressure H does not fluctuate for a long time. This static pressure value Ha is set as $H_{min}$ (1), namely $Ha = H_{min}$ (1), and then the vacuum cleaner 1 is operated at the rotational speed Na.

The minimum static pressure value Hb of the suction performance characteristic is set as a setting value in the case in which the load fluctuation with use number of the suction nozzle is small, namely, the number of fluctuations is, during use of the suction nozzle, one or two times per predetermined detecting period T. This static pressure value Hb is set as $H_{min}(2)$, namely $Hb = H_{min}(2)$.

Next, in a sequence corresponding to the increase in the number of fluctuations of the static pressure H by the operation of the suction nozzle per predetermined detecting period T, the vacuum cleaner 1 is operated at a rotational speed Nc and hereafter at rotational speed Nd so as to increase the suction performance characteristic to the static pressure Hc and Hen the static pressure Hd.

Figure 12A:
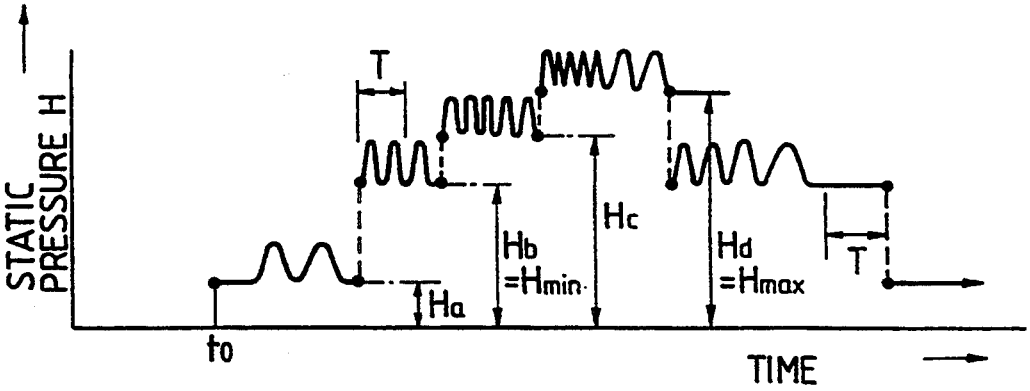
FIG. 12A is a graphical illustration showing a relationship between a static pressure of an electric driven blower motor and a cleaning time of another embodiment of a suction performance characteristic control according to the present invention.
Figure 12B:
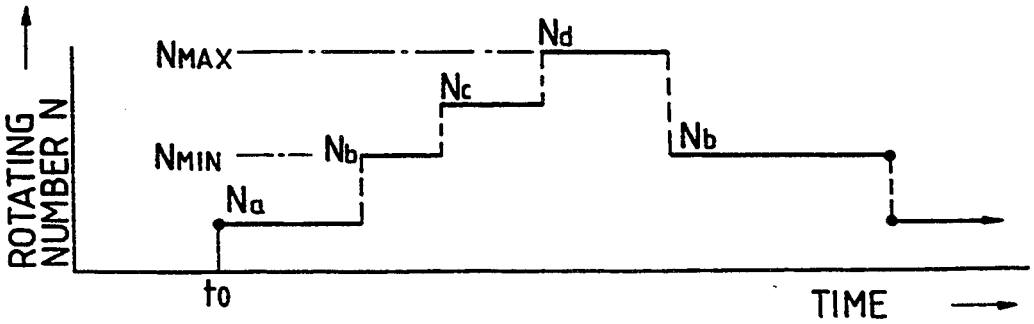
FIG. 12B is a graphical illustration showing a relationship between a rotational speed of an electric driven blower motor and a cleaning time of another embodiment of a suction performance characteristic control according to the present invention.

In FIG. 12A and FIG. 12B, the maximum static pressure value Hd of the suction performance characteristic is set as a setting value in the case in which the number of load fluctuations, e.g., the operation number is large, namely, the suction nozzle is operated such that here is a high frequency of load fluctuations. This static pressure value Hd is set as $H_{max}$, namely $Hd = H_{max}$.

When the operation number of the suction nozzle decreases, the vacuum cleaner 1 carries out an operation to lower the suction performance characteristic corresponding to the frequency of the load fluctuations.

As stated above, the suction performance characteristic of the vacuum cleaner 1 is strong under a high speed operation and is weak under a slow speed operation. Thereby it is possible to realize the automatic control for the suction performance characteristic property which is suited to the operator's feeling.

Further, since the setting values at the lower limit side for the suction performance characteristic property are set in two steps, namely $Ha = H_{min}(1)$ and $Hb = H_{min}(2)$, the necessary suction force Hb is obtained. Thereby, when the operator does not move the vacuum cleaner 1 or when the operator does not carry out an operation of the suction nozzle for a long time, then the suction force is lowered and an electric power reduction for the vacuum cleaner can be realized.

Figure 8:
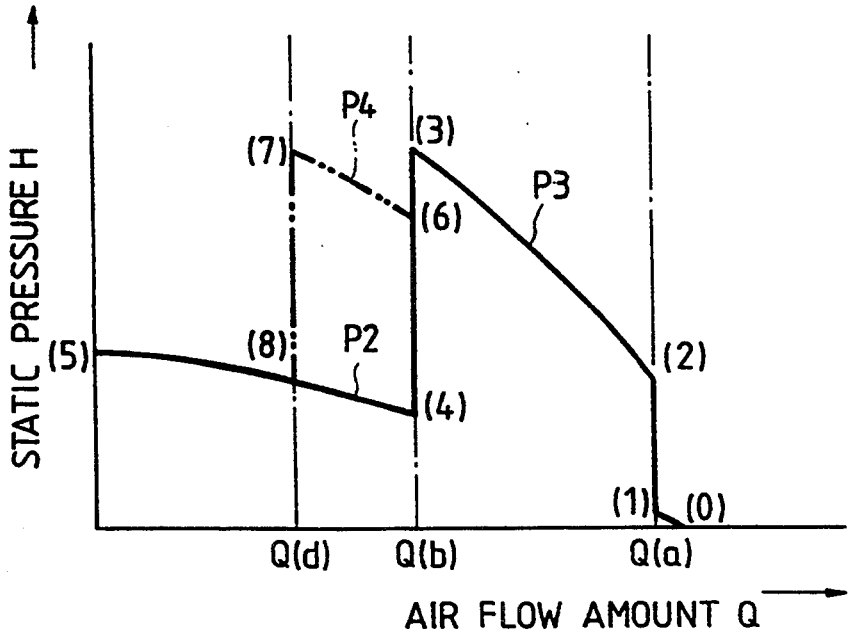
FIG. 8 is a graphical illustration of an aerodynamic suction performance characteristic property showing a relationship between an output characteristic property of an electric driven blower motor and a load characteristic property according to the present invention.

Furthermore, the above stated control range of the air flow amount is indicated in the example having the control range between the air flow amount Q(b) and the air flow amount Q for setting the suction performance characteristic (d) shown in FIG. 8. However, the control range of the air flow amount Q is not limited the above stated example.

By carrying out the control for the suction performance characteristic property corresponding to the existence and the number of load fluctuations in accordance with the operation of the suction nozzle over the entire air flow range, the electric power reduction and the low noise operation of the vacuum cleaner under a non-cleaning condition can be attained.

Moreover, by carrying out the control for the suction performance characteristic property in dependence upon the frequency of the operation number of the suction nozzle, similar effects stated above can be obtained.

As stated above, in the general suction nozzle 7, the fluctuating width is small. However, in the crevice nozzle 8, the fluctuating width is large because of the adhesion and the release of the suction nozzle are repeated. Therefore, it is possible to discriminate the type of suction nozzle in accordance with a predetermined judging value. Namely, according to the discriminating route as represented by the flow-chart shown in FIG. 15, the upper limit value of the air flow amount Q for the control change-over to a different suction performance characteristic as discussed previously with reference to FIG. 8 or the lower limit value of the air flow amount for the control change-over, or both values of the air flow amount for the respective control change-over are renewed to a predetermined setting value which has been preset in dependence upon the detected fluctuation width and, hence, nozzle type.

Hereinafter, the examples will be explained referring to FIG. 13 and FIG. 14 in which the suction performance characteristic property of the vacuum cleaner 1 having the above stated construction is controlled.

Figure 13:
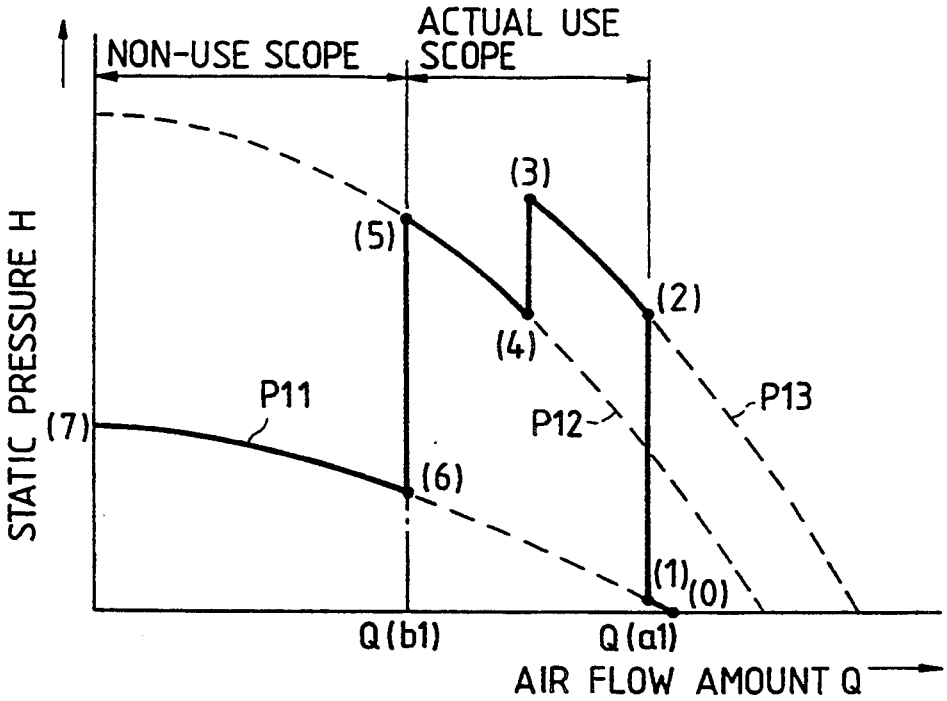
FIG. 13 is a graphical illustration of an aerodynamic suction performance characteristic showing a relationship between an output characteristic property of an electric driven blower motor and a load characteristic property in a general floor suction nozzle.

In FIG. 13, curves P11, P12 and P13 are output suction performance characteristic properties. In FIG. 14, curve P14, P15 and P16 are output suction performance characteristic properties.

Figure 15:
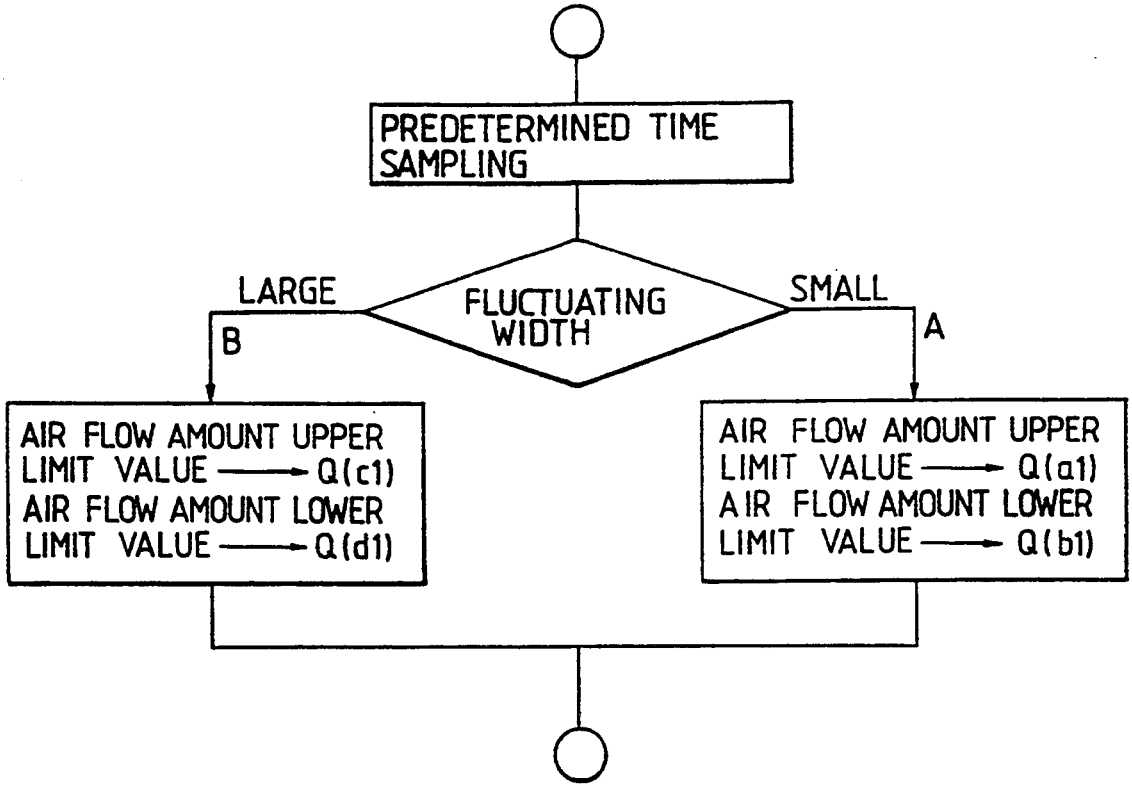
FIG. 15 is a flow-chart showing a discriminating route of an air flow amount in a change-over control according to the present invention.

Namely, FIG. 13 shows a case wherein the fluctuating width of the detected value is small and it is judged at the side of the route A of FIG. 15. This case is suited to the suction nozzle 7, and the control upper limit value of the air flow amount Q(al) and the control lower limit value of the air flow amount Q(b1) have been set.

These control limit values are set respectively corresponding to the maximum air flow amount in which the filter member 4 is not clogged when the suction nozzle is in contact with the floor within the actual use range of the suction nozzle 7 and to the lower limit value of the air flow amount of the dust suction performance characteristic property when the filter member is clogged.

Further, the curves P11, P12, P13 in FIG. 13 are output characteristic properties of the electric driven blower motor 2. The output characteristic property curves P11, P12 and P13 have been preset so as to be suited to the above stated general suction nozzle 7. By changing over the suction performance characteristic property, the curves representing the predetermined suction performance characteristic property can be attained.

Namely, a route (0)→(1)→(2)→(3)→(4)→(5)→(6)→(7) in FIG. 13, the range more than the upper limit value of the air flow amount Q(al) and the range less than the lower limit value of the air flow amount Q(b1) are out of the actual use range, respectively. Accordingly, it is unnecessary to output the unnecessary output and it can operate with the low output characteristic property shown in the curve P11.

The range of a route (0)→(1) more than the upper limit value of the air flow amount Q(al) in FIG. 13 is the non-cleaning condition when the suction nozzle is lifted. In such above stated case, as shown in the route (0)→(1)in FIG. 13, by lowering the output, the electric power reduction and the noise reduction for the vacuum cleaner can be attained.

Further, the route (6)→(7) less than the lower limit of the air flow amount Q(b1) is a range when the dust suctioning ability is insufficient. In such above stated case, as shown in the route (6)→(7) in FIG. 13, by lowering the output, the operator can notice the condition in which the filter member 4 reaches a clogging limitation, and at the same time the electric power reduction and the noise reduction effects for the vacuum cleaner can be attained.

In addition to the above, even when the thin material such as a curtain is absorbed and adheres closely to the suction nozzle and then the air flow amount Q is lowered, by decreasing the suction performance characteristic property, the release and the absorption for the suction nozzle can be easily carried out.

Besides, in FIG. 13, the range of the air flow amount Q(a1)–Q(b1) is the actual use range in the actual cleaning condition. Within this actual use scope, it can realize the most suitable suction performance characteristic which is suited to the general floor suction nozzle 7. In the embodiment shown in FIG. 13, control through the command from the executing and processing apparatus 10 can be attained. Namely, on the output characteristic curve P13 indicated by a route (2)-(3) or on the output characteristic curve P12 indicated by a route (4)-(5), it can change over between a route (3)→(4) .

Further, in this example, within the actual use range during the actual cleaning condition, two output characteristic curves P12 and P13 are shown. However, it can change over and combine through a large number of the output characteristic curves.

Figure 14:
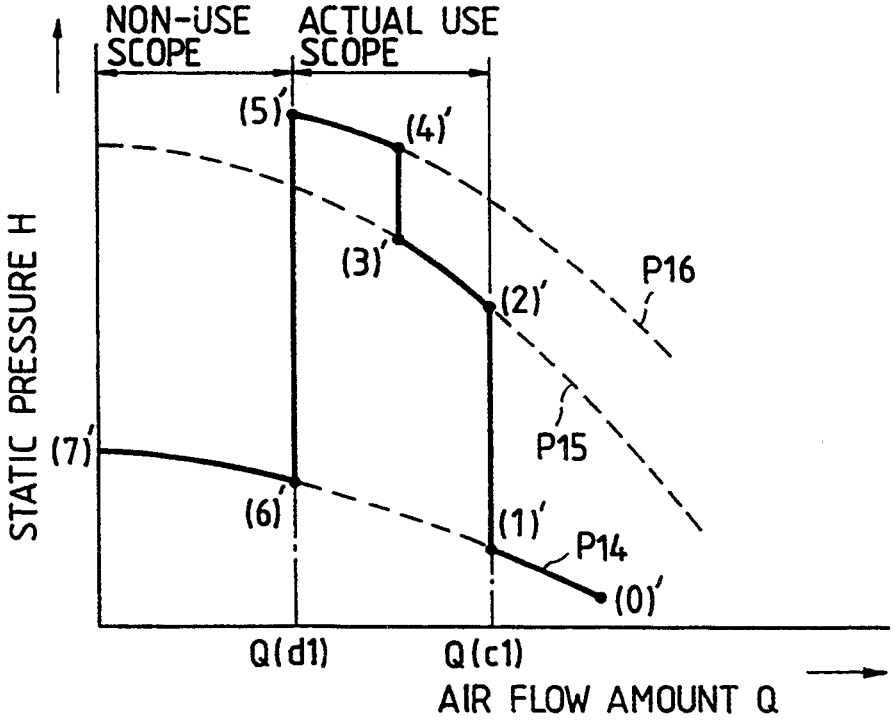
FIG. 14 is a graphical illustration of an aerodynamic suction performance characteristic showing a relationship between an output characteristic property of an electric driven blower motor and a load characteristic property in a crevice suction nozzle.

FIG. 14 shows a case wherein the fluctuating width of the detected value is large and it is judged at the side of the route B of FIG. 15. This case is suited to the suction nozzle 8, and the control upper limit value of the air flow amount Q(cl) and the control lower limit value of the air flow amount Q(d1) have been set.

Further, the curves P14, P15, P16 in FIG. 14 are the output characteristic curves of the electric driven blower motor 2. The output characteristic curves P14, P15 and P16 have been preset so as to be suited to the crevice suction nozzle 8. Similar to the example shown in FIG. 13, by changing over the curves, the suction performance characteristic passing through the route (0)'→(1)'→(2)'→(3)'→(4)'→(5)'→(6)'→(7)' can be realized.

FIG. 14 differs from the embodiment shown in FIG. 13, in that the values of the air flow amount Q(c1) and the air flow amount Q(d1) are changed and the state of the suction performance characteristic between the air flow amount Q(c1)–Q(d1) is changed.

In FIG. 14, the curve P14 representing the output characteristic of the electric driven blower motor 2 is set equal to the curve P11 shown in FIG. 13 and also the curve P15 representing the output characteristic of the electric driven blower motor 2 is equal to the curve P12 shown in FIG. 13, respectively. However, it is unnecessary to limit the curves P14 and P15 shown in FIG. 14 to the curves P11 and P12 shown in FIG. 13, respectively.

As stated above, the type of the suction nozzle is judged according to the dimension of the fluctuating width of the detected value, and in accordance with the judging command, it is possible to operate with the most suitable suction performance characteristic within the air flow amount range which is suited to the suction nozzle mounted on the cleaner main body 3. Additionally, it is possible to judge a dimension of the fluctuating width by the predetermined judging value and thereby determine the type of suction nozzle employed.

It is also possible to compare the fluctuating width by the provision of a plurality of discriminating values and the type of suction nozzle is discriminated by this approach; therefore, the operation characteristic control can be carried out in a manner suitable for the respective suction nozzle.

Further, not only by the fluctuating width of the detected value but also by discriminating the fluctuating pattern or the fluctuating state according to the sampling at the predetermined period, the type of suction nozzle can be judged.

A further embodiment of the vacuum cleaner having a brushless direct current motor according to the present invention will be explained hereinbelow.

Figure 16:
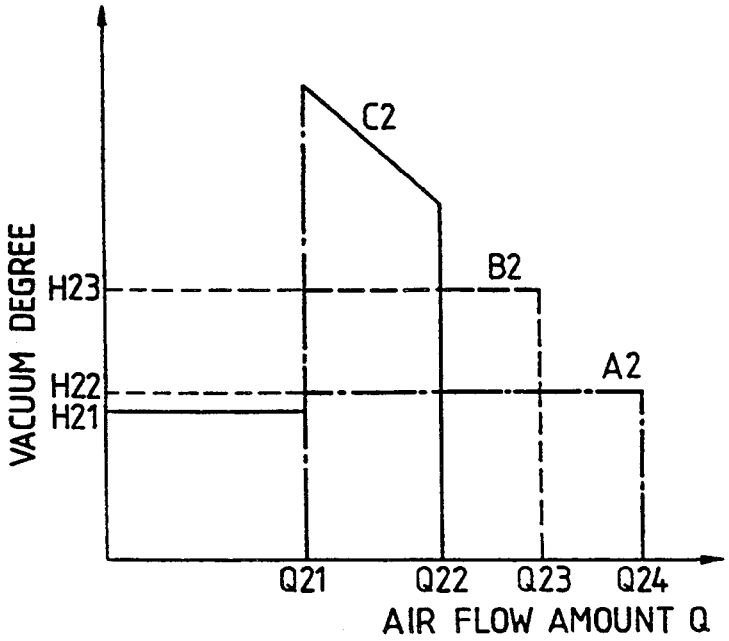
FIG. 16 is a graphical illustration of a vacuum degree and an air flow amount relationship showing an operation characteristic in a respective suction nozzle.

Herein, one example of the operation characteristic in the vacuum cleaner will be indicated in FIG. 16. FIG. 16 is a vacuum degree, an air-flow amount characteristic chart diagram showing one example of the operation suction performance characteristic in the vacuum cleaner according to the present invention.

In FIG. 16, an operation characteristic A2 is used for the floor as a cleaning surface to be cleaned. This operation characteristic is a combination of a constant air flow amount Q24 and a constant vacuum degree H22, and, at less than air flow amount Q21, the operation is under a constant vacuum degree H21.

Similar to the above, an operation characteristic B2 is used for a tatami as a cleaning surface to be cleaned, and an operation characteristic C2 is used for the carpet as a cleaning surface to be cleaned, respectively. In the operation characteristic C2 for the carpet, a slant characteristic between the air flow amount Q21 and Q22 shows under the constant rotation operation characteristic of the electric driven blower motor.

Even in each of the above stated operation characteristics, at less than the air flow amount Q21, the operation is under the constant vacuum degree H21. Namely, at less than the air flow amount Q21, the air flow amount is in a region in which the air flow amount is lowered by a clogging of the filter member in the vacuum cleaner. This range is not the actual use range during the vacuum cleaner use and the operation characteristic is only one.

Besides, the above stated constant air flow amount operation, the constant vacuum degree operation and the constant rotational speed of the electric driven blower motor will be explained hereinbelow.

Next, the means for judging and properly selecting a plurality of the operation suction performance characteristics and further changing over the most suitable operation suction performance characteristic for the respective cleaning surface to be cleaned will be explained.

Namely, in a case of the use of the vacuum cleaner 1, when the suction nozzle is reciprocatively moved on the cleaning surface, the adhesion degree between the suction nozzle and the cleaning surface changes, further the vacuum degree of the interior portion of the vacuum cleaner, the electric current of the electric driven blower motor and the suction air flow amount of the electric driven blower motor change. The above stated changing amounts are sensed as the changing amounts of the operation condition in the vacuum cleaner.

Attention is given to the difference in the changing amount of the vacuum degree, the electric current and the air flow amount by the reciprocating motion of the suction nozzle of the vacuum cleaner changing amounts determined by the cleaning surface when the same suction nozzle is used. Therefore, a judgment can be made as to the type of the cleaning surface to be cleaned, and the operation characteristic is changed in dependence upon the judged result.

Figure 17:
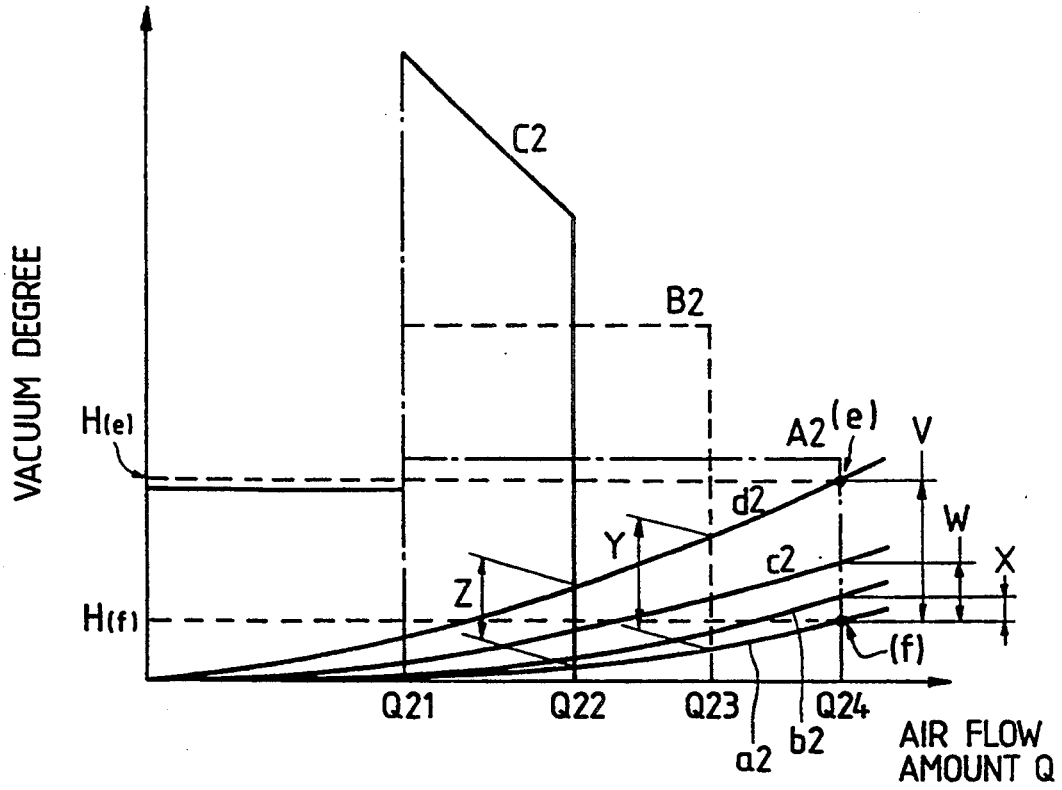
FIG. 17 is a graphical illustration of a vacuum degree and an air flow amount relationship showing an operation characteristic in a respective suction nozzle and a load fluctuation in a respective suction nozzle.

The above stated facts will be explained in more detail referring to FIG. 17. FIG. 17 is a view in which the load fluctuating curve during the reciprocating motion of the suction nozzle on the cleaning surface is superposed against the vacuum degree and the air flow amount characteristic chart shown in FIG. 16.

In FIG. 17, curves a2, b2, c2 and d2 are load characteristics of the suction nozzle. In FIG. 17, when the cleaning portion to be cleaned is the floor portion, in a case that the suction nozzle of the vacuum cleaner 1 is moved reciprocatively on the floor portion, then the load curve of the suction nozzle changes between the curve a2 and the curve b2.

Further, when the cleaning surface is a tatami surface, and the suction nozzle of the vacuum cleaner is moved reciprocatively on the tatami surface, then the load curve of the suction nozzle changes between the curve a2 and the curve c2.

Further, when the cleaning surface is a carpet, and the suction nozzle of the vacuum cleaner is moved reciprocatively on the carpet, then the load curve of the suction nozzle changes between the curve a2 and the curve d2.

Accordingly, when the vacuum cleaner is operated at the suction performance characteristic A2 and the carpet is cleaned, the point on the characteristic A2 exists between the point (e) and a point (f) under the constant air flow amount Q24. At this time, the vacuum degree changes between a value of H(e) and a value of H(f) according to the reciprocating motion of the suction nozzle of the vacuum cleaner 1. The changing width of the vacuum degree is a width indicated by V.

Further, when the vacuum cleaner is operated at the suction performance characteristic A2 shown in FIG. 17 by the executing and the processing apparatus 10 and the tatami surface is cleaned, the magnitude or width of the change in the vacuum degree on the characteristic A2 at a constant air flow Q24 is a width indicated by W.

Further, when the vacuum cleaner is operated at the characteristic A2 and the floor is cleaned, the magnitude or width of the change in the vacuum degree on the characteristic A2 at a constant air flow Q24 is a width indicated by X.

As stated above, when the air flow amount of the vacuum cleaner is constant, the cleaning surface to be cleaned is discriminated i.e., is determined according to the magnitude or width of the change the vacuum degree as the suction nozzle is reciprocated on the surface. By thus detecting the type of surface, the appropriate one of the suction performance characteristics, for example A2, B2 or C2 in FIG. 16 can be employed or selected by the processing of apparatus 10 for operation of the vacuum cleaner.

Additionally, even when the same carpet portion is cleaned, the changing width of the vacuum degree is a width indicated by Z in the case of the constant air flow amount Q22 and the changing width of the vacuum degree is a width indicated by Y in the case of the constant air flow amount Q23. This fact is applied during the cleaning operation for the tatami surface or for the floor in order to discriminate the type of surface being cleaned for selection or use of the appropriate stored suction performance as for example A2, B2 or C2 in FIG. 16.

The above stated discriminating threshold value for determining the type of surface may be determined by dividing the detected changing width of the vacuum degree by the mean value hereof and providing herefrom a dimensionless number of the changing rate of the vacuum degree which can be used in the determination of the surface being cleaned.

In the above stated case, the change of the vacuum degree is utilized as the changing amount of the operation condition of the vacuum cleaner 1 under the operation of the constant air flow amount Q.

In place of the above case, it is possible to utilize a change of the electric current value of the electric driven blower motor 2 in accordance with the load fluctuation of the suction nozzle of the vacuum cleaner as the changing amount of the operational condition of the vacuum cleaner 1.

Besides, during the operation of the constant vacuum degree, it is possible to use the change of the air flow amount Q and the change of the electric current as the changing amount of the operational condition of the vacuum cleaner 1. And during operation at a constant rotational speed, it is possible to use the change of the vacuum degree, the change of the air flow amount Q and the change of the electric current as the changing amount of the operational condition of the vacuum cleaner.

Hereinafter, the control method for the above embodiment according to the present invention will be explained referring to FIG. 18.

In this embodiment, a brushless direct current motor 25 is used as the electric driven blower motor, and the rotational speed is varied according to an inverter control.

Figure 18:
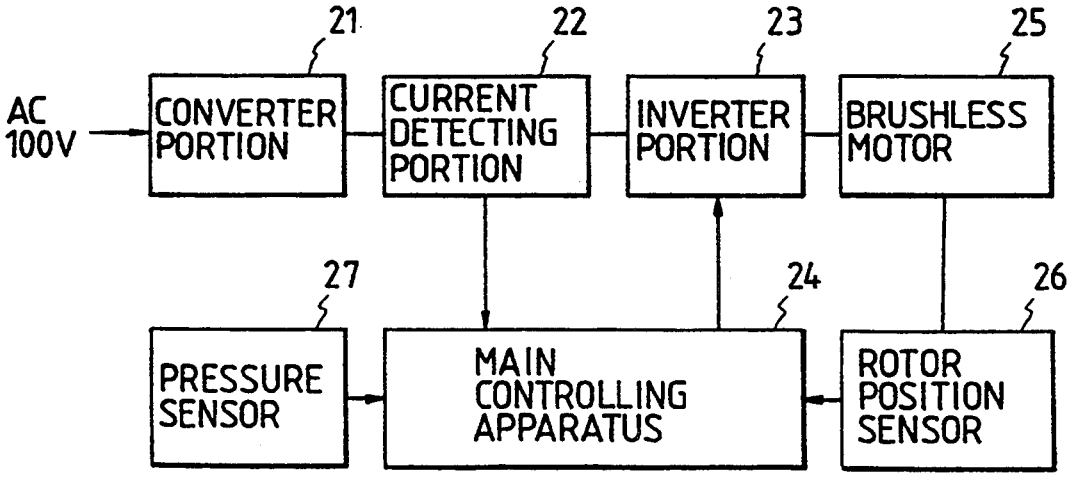
FIG. 18 is a control block diagram showing another embodiment of a controlling apparatus according to the present invention.

In FIG. 18, the commercial electric power source (alternating current 100 V) supplied from a socket (not shown) is rectified to direct current at a converter portion 21 and the direct current is supplied to an inverter portion 23 through an electric current detecting portion 22. The inverter portion 23 generates three-phase alternating current by a firing signal from a main controlling circuit 24 and supplies it to the brushless direct current motor 25.

The brushless direct current motor 25 is provided with a rotor position detecting sensor 26 which loads back a position of the rotor to the main controlling circuit 24. Further, a pressure sensor for detecting the vacuum degree of the interior portion of the vacuum cleaner is connected to the main controlling circuit 24. The pressure sensor is located in the cleaner main body on the suction side of the blower motor as shown at point Z in the block diagram of FIG. 1, as described earlier herein.

In the above stated construction, when the vacuum cleaner is operated by a constant air flow amount, the air flow amount sensor is used and, utilizing the output power, the negative feedback control may be carried out with respect to the rotational speed of the brushless direct current motor 25.

However, in this embodiment of the present invention, since an air flow amount sensor is not provided, the rotational speed of the brushless direct current motor 25 is calculated according to the electric current value from the electric current detecting portion 22 and the rotor position detecting sensor 26. The air flow amount is determined by these values and the operation under the constant air flow amount is carried out according to the determined air flow amount.

Further, with respect to the operation under the constant vacuum degree and the operation under the constant rotational speed, it is controlled by the pressure sensor 27 and a rotor position detecting sensor 26, respectively.

According to the above stated construction, the vacuum degree, the air flow amount and the electric current value of the brushless direct current motor 25 are constantly monitored as the changing condition of the operation condition of the vacuum cleaner 1 and then the change-over of the operation suction performance characteristic of the vacuum cleaner is carried out.

Figure 19:
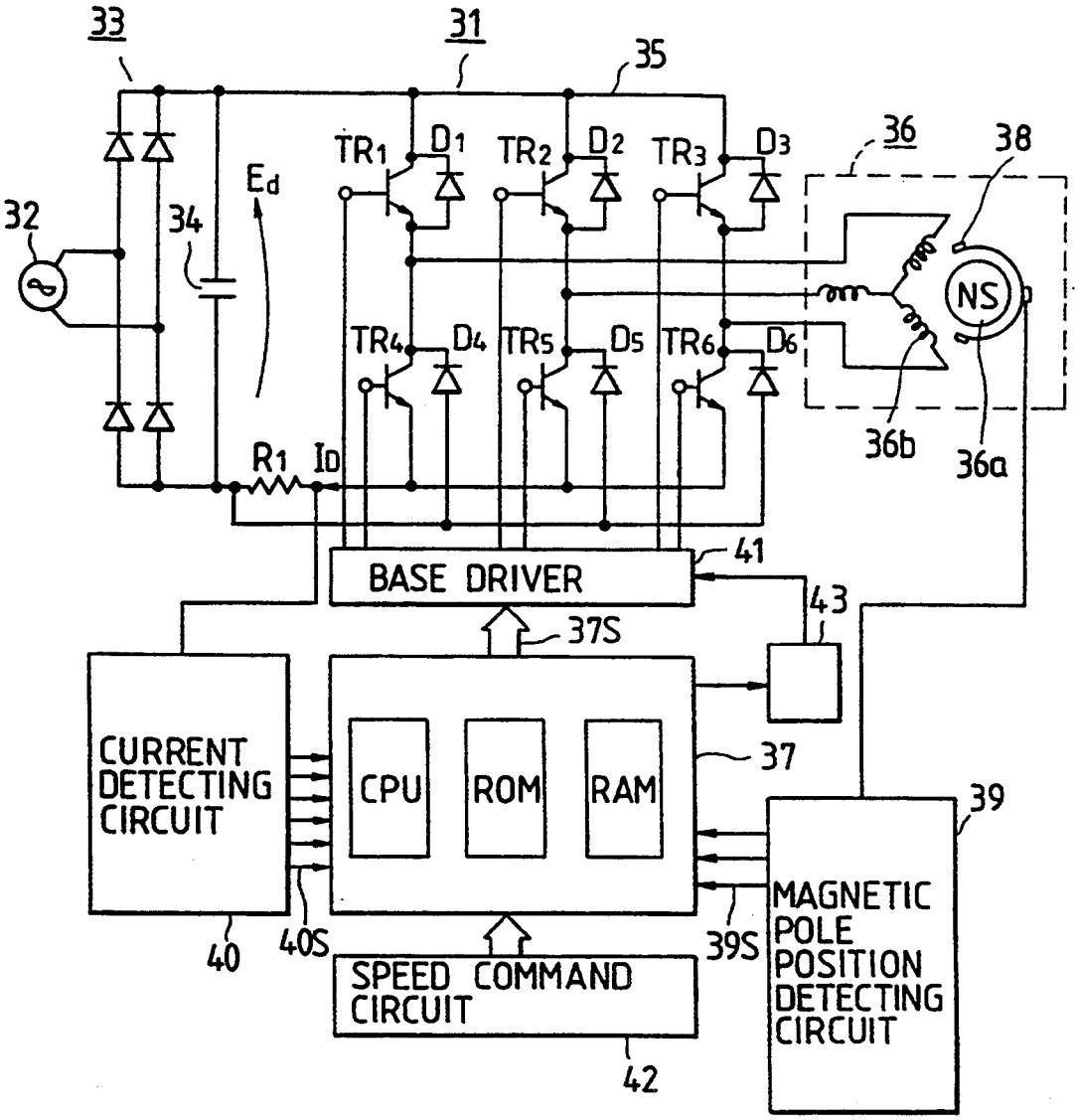
FIG. 19 is a schematic view of a speed controlling apparatus comprising a brushless direct motor and an inverter controlling apparatus of another embodiment of a vacuum cleaner according to the present invention.

Hereinafter, the vacuum cleaner having an improved brushless direct current motor will be explained referring to FIGS. 19–22. FIG. 19 is a whole construction view showing a speed controlling apparatus comprising a brushless direct current motor 36 and an inverter controlling apparatus 31.

Figure 21:
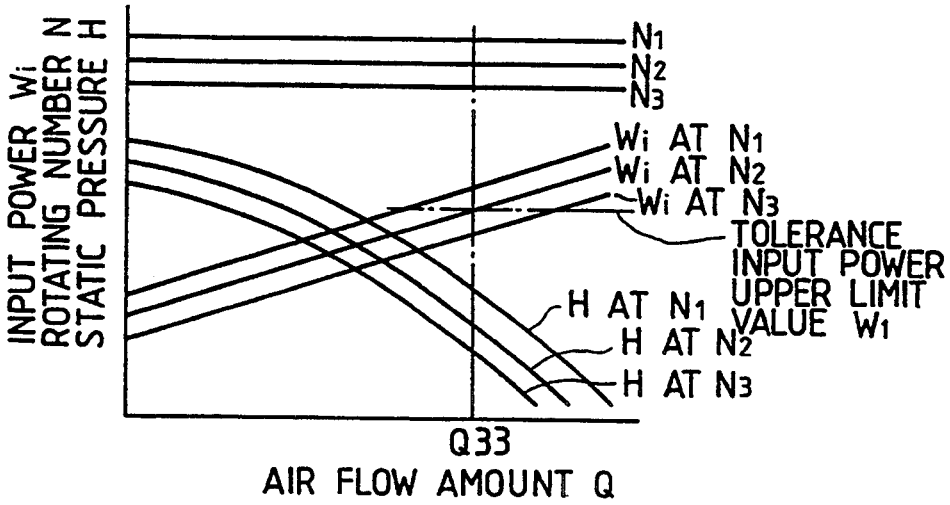
Figure 22:
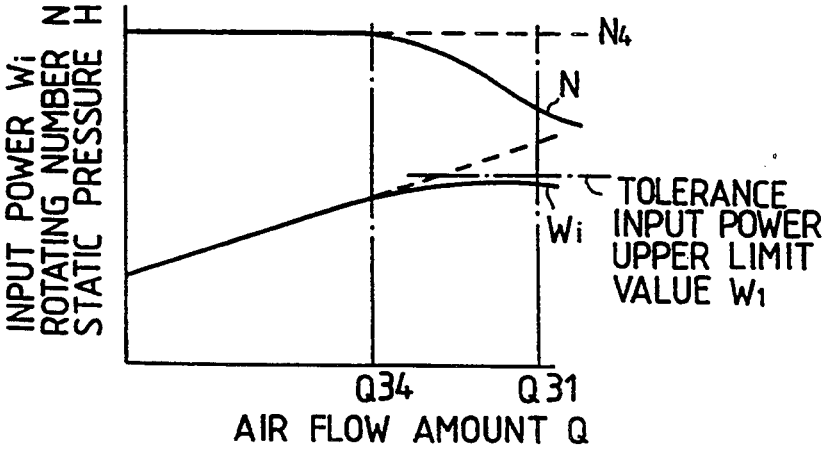
FIG. 22 is a graphical illustration of a characteristic of a vacuum cleaner having an input limiting function.

FIG. 21 and FIG. 22 are graphical illustrations of suction performance characteristics of the vacuum cleaner employing the chopper control system inverter driven brushless direct current motor 36 as a driving source, and FIG. 22 is a graphical illustration of suction performance characteristics of the vacuum cleaner comprising an input power limiting function according to the present invention.

In FIG. 19, the inverter controlling apparatus 31 obtains the direct current voltage $E_d$ from an alternating current power source 32 through a rectifier circuit 33 and a smoothing circuit 34 and supplies it to an inverter apparatus 35.

The inverter apparatus 35 is a 120° resistance type inverter comprising transistors $TR_1$–$TR_6$ and reflux diodes $D_1$–$D_6$. An alternating current output voltage of the inverter apparatus 35 is controlled according to a chopper-operation for the conductive voltage side (electric angle 120°) of the positive electric voltage side transistors $TR_1$–$TR_3$ of the direct current voltage $E_d$ by receiving a pulse width modulation.

Further, a low resistor $R_1$ is connected between common emitter terminals of the transistors $TR_4$–$TR_6$ and common anode terminals of the reflux diodes $D_4$–$D_6$.

The brushless direct current motor 36 comprises a rotor **36*a* having two pole type permanent magnets as the magnetic field, and a stator into which an armature winding 36*b* is inserted. A winding current flowing in the armature winding 36*b* flows also to the low resistor $R_1$, and a load current $I_D$ of the brushless direct current motor 36** is detected according to the voltage drop of the low resistor $R_1$.

A controlling circuit for controlling the speed of the brushless direct current motor 36 comprises a microcomputer 37 including a CPU, ROM and RAM, a magnetic pole position detecting circuit 39 for detecting a magnetic pole position of the rotor **36*a* by receiving an output power from an element 38, an electric current detecting circuit 40 for detecting a value of the load electric current $I_D$ according to the voltage drop of the low resistor $R_1$, a base driver 41 for driving the transistors $TR_1$–$TR_6$, and a speed commanding circuit 42 for transmitting a standard speed to the micro-computer 37**.

The electric current detecting circuit 40 detects the load electric current $I_D$ by receiving the voltage drop of the low resistor $R_1$ and forms an electric current detecting signal 40S by an A/D converter (not shown).

In the ROM, the various kinds of processing programs necessary for driving the brushless direct current motor 36, for example, programs such as speed executing processing, a command taking-in processing and a speed controlling processing are memorized.

Besides, the RAM comprises a memorizing portion for taking-in the various data which is necessary for carrying out the above stated various kinds of processing programs.

The transistors $TR_1$–$TR_6$ receive a firing signal 37S from the micro-computer 37 and are driven by the base driver 41.

A voltage commanding circuit 43 forms a chopper signal. Namely, in the brushless direct current motor 36, the winding current flowing to the armature winding **36*b* corresponds to an output torque of this brushless direct current motor 36** and controls the winding current at every rotation position. Therefore, it is possible to carry out a continuous control for the output torque.

Figure 20:
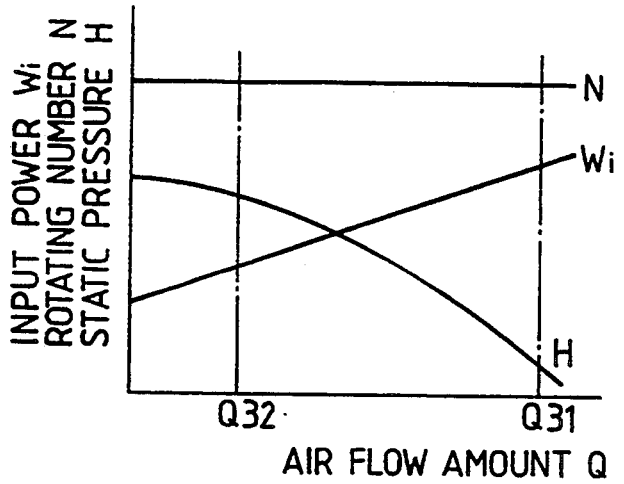
FIGS. 20 and 21 are graphical illustrations of characteristics characteristic property of a vacuum cleaner in which a brushless direct motor is used as a driving source.

As has been stated already, FIG. 20 shows a suction performance characteristic of the vacuum cleaner 1 employing the brushless direct current motor 36 as a driving source. Along the horizontal axis, the air flow amount Q passing through the vacuum cleaner is indicated, and along the vertical axis, the static pressure H represents the suction force of the vacuum cleaner, a rotational speed N of the brushless direct current motor 36 and an input power $W_i$ are indicated.

The motion range of the vacuum cleaner has a range from the point Q31 of the maximum motion or air flow to the point Q32 of the minimum motion. A vicinity of the maximum motion point Q31 corresponds to the state in which the suction nozzle port is remote from the cleaning surface, and requires maximum electric power.

As shown in FIG. 21, it is possible to realize the most suitable suction performance characteristic for the vacuum cleaner, namely, in accordance with the suitable selection of each of the curves corresponding to a plurality of rotational speeds and the change over operation control, as the combination of the basic suction performance characteristic shown in FIG. 20.

However, taking a look at the aspect of the restraining condition with respect to the input power $W_i$, from the relationship from the electric current capacity of the controlling element and the temperature rise, etc., it is preferred to not exceed the tolerance input power upper limit value $W_1$.

For example, when the rotational speed $N_1$ is selected at the point of the air flow amount Q33, and the input power $W_i$ exceeds the tolerance input power upper limit value $W_1$, an over load condition results.

Herein, when the above stated input power $w_i$ is in a range of more than the stored tolerance input power upper limit value $W_1$, by the stored processing programs in the room of the controlling apparatus, when the rotational speed commanding value is lowered to the rotational speed $N_2$ or the rotational speed $N_3$, it is possible to avoid the over load condition. However, the processing program of the controlling apparatus becomes complicated.

Further, it may employ the special monitoring apparatus for the over load condition; however, the cost of the apparatus or the size of the apparatus is increased.

In this embodiment of the present invention, it is desired that in the range a air flow between from the air flow amount Q33, being the non-cleaning condition in which the suction nozzle is increased lifted up off the surface to be cleaned, to the air flow amount Q31, that is greater suction force be produced than necessary. Therefore, in this embodiment of the present invention, at the vicinity of the above stated range, the input power $W_i$ is automatically restrained.

As shown in FIG. 22, the magnetomotive force of the rotor **36*a* and the winding number of the armature winding 36*b* are set so as to balance the power source voltage against the counter-electromotive force and are set so that the air flow amount Q of the load condition is the duty factor 100% with respect to the air flow amount Q34**.

Accordingly, when the air flow amount Q is greater than the air flow amount Q34, the rotating number $N_4$ is gradually reduced from the commanding value rotational speed according to the increase in the load, and the increase in the input power $W_i$ is gradually increased. Therefore, it is possible to control an increase in the input power $W_i$ automatically to a the predetermined value which is lower than the tolerance input power upper limit value $W_1$.

As stated above, even when it is operated at any speed commanding value, at the large load side in which the duty factor of the chopper control exceeds 100%, it is possible to automatically restrain the increase in the input power $W_i$.

Further, even when the high speed commanding value is outputted by an abnormality of the speed commanding circuit 42 and the micro-computer 37, it is possible to automatically prevent the abnormal high speed operation of the brushless direct current motor 36.

We claim:

1. A vacuum cleaner useable with a suction nozzle selected from among various suction nozzles having different air flow characteristics, comprising a detecting apparatus for detecting the magnitude of fluctuations of at least one of vacuum static pressure in the cleaner created by the operation of an electric driver blower motor of the vacuum cleaner, an air flow rate in the cleaner as a result of operation of said blower motor and an electric current of said electric driven blower motor, which fluctuations are dependent upon the selected nozzle of said various suction nozzles utilized on the vacuum cleaner, and a controlling apparatus for controlling the operation of said electric driven blower motor in accordance with the magnitude of the fluctuations detected by said detecting apparatus so that said blower motor is operated with a suction performance characteristic in dependence upon the particular nozzle selected, and said controlling apparatus being adapted to selectively increase the suction performance characteristic when the nozzle is in use and decrease the suction performance characteristic when the nozzle is not applied to a surface being cleaned.

2. A vacuum cleaner according to claim 1, wherein said controlling apparatus is adapted to set an upper limit value for increasing the suction performance characteristic and a lower limit value for decreasing the suction performance characteristic.

3. A vacuum cleaner according to claim 2, wherein, when the suction nozzle is not applied to a surface to be cleaned for a predetermined time period, the suction performance characteristic is lowered.

4. A vacuum cleaner useable with a suction nozzle selected from among various suction nozzles having different air flow characteristics, comprising a detecting apparatus for detecting the magnitude of fluctuations of at least one of vacuum static pressure in the cleaner created by the operation of an electric driven blower motor of the vacuum cleaner, an air flow rate in the cleaner as a result of operation of said blower motor and said electric current of an electric driven blower motor, which fluctuations are dependent upon the selected nozzle of said various suction nozzles utilized on the vacuum cleaner, and a controlling apparatus for controlling operation of said electric driven blower motor of the vacuum cleaner in accordance with the magnitude of the fluctuations detected by said detecting apparatus so that said blower motor operates with a suction performance characteristic in dependence upon the particular nozzle selected, and wherein said controlling apparatus is adapted to lower the suction performance characteristic level when the suction nozzles is not applied to a surface to be cleaned for more than a predetermined period of time.

5. A vacuum cleaner according to claim 1, wherein the suction performance characteristic cumulatively increases to a predetermined amount when the nozzle is applied to the surface to be cleaned; and, wherein the suction performance characteristic accumulatively decreases to a predetermined amount when the nozzle is not applied to the surface to be cleaned.

6. A vacuum cleaner according to claim 5, wherein in said controlling apparatus an upper limit value for increasing the suction performance characteristic and a lower limit value for decreasing the suction performance characteristic are preset for each suction nozzle of said various suction nozzles.

7. A vacuum cleaner according to claim 1, wherein the suction performance characteristic cumulatively increases to a predetermined amount when the nozzle is applied to the surface to be cleaned; and, wherein the suction performance characteristic accumulatively decreases to a predetermined amount when the nozzle is not applied to the surface to be cleaned.

8. A vacuum cleaner according to claim 7, wherein an upper limit value for increasing the suction performance characteristic and a lower limit value for decreasing the suction performance characteristic are preset for each suction nozzle of said various suction nozzles.

9. A vacuum cleaner adapted to selectively exchangeably accommodate a plurality of different types of suction nozzles, the vacuum cleaner comprising means for storing preset air flow rate ranges for operating an electric driven blower motor of the vacuum cleaner, said air flow rate ranges corresponding to respective ones of the different types of suction nozzles, controlling means for selecting an air flow rate range from said means for storing suitable for the respective suction nozzles upon an exchange of said suction nozzles, and means for determining what suction nozzle is accommodated on said vacuum cleaner so that the suitable air flow rate range can be selected by said controlling means.

10. A vacuum cleaner adapted to selectively exchangeably accommodate a plurality of different types of suction nozzles, the vacuum cleaner comprising an air flow rate detecting means for detecting a suction air flow rate in said vacuum cleaner caused by operation of an electric driven blower motor of the vacuum cleaner during a cleaning operation of the vacuum cleaner, control means for controlling operation of said electric driven blower motor of the vacuum cleaner in response to a detected amount of said air flow rate detected by said detecting means for controlling a suction performance characteristic of said blower motor and, said control means including a suction nozzle discriminating apparatus for discriminating the type of suction nozzle accommodated on the vacuum cleaner and for controlling a plurality of upper limit values of said air flow rates in dependence upon the discriminated type of suction nozzle accommodated on the vacuum cleaner so as to reduce the suction performance characteristic of the vacuum cleaner at a time of an air flow rate condition greater than an upper limit value corresponding to the nozzle accommodated on the vacuum cleaner.

11. A vacuum cleaner according to claim 10, wherein said suction nozzle discriminating apparatus discriminates the type of suction nozzle accommodated on the vacuum cleaner in dependence upon the magnitude of fluctuations in at least one of a vacuum static pressure in the cleaner, said air flow rate and an electric current of said electric driven blower motor of the vacuum cleaner, which fluctuations are dependent upon the type of suction nozzle accommodated on the vacuum cleaner, and changes a control air flow rate upper limit value in accordance with a signal of said suction nozzle discriminating apparatus.

12. A vacuum cleaner according to claim 11, wherein said control means for controlling the suction performance characteristic in response to a detected amount of said air flow rate from said detecting means changes the air flow rate so that it is in a range less than the upper limit value of said control air flow rate.

13. A vacuum cleaner adapted to selectively exchangeably accommodate a plurality of different types of suction nozzles, the vacuum cleaner comprising an air flow rate detecting means for detecting a suction air flow rate in said vacuum cleaner caused by operation of an electric driver blower motor of the vacuum cleaner during a cleaning operation by the vacuum cleaner, means for controlling a suction performance characteristic of an electric driven blower motor of the vacuum cleaner in response to a detected amount of said air flow rate detected by said detecting means, and said controlling means including a suction nozzle discrimination apparatus for discriminating the type of suction nozzle accommodated on the vacuum cleaner and for setting a plurality of lower limit values of said air flow rates in dependence upon the opening area of the discriminated type of suction nozzle accommodated on the vacuum cleaner so as to reduce the suction performance characteristic at a time of an air flow rate less than the respective lower limit value corresponding to the type of suction nozzle accommodated on the vacuum cleaner.

14. A vacuum cleaner according to claim 13, wherein said suction nozzle discriminating apparatus discriminates the type of suction nozzle in dependence upon a magnitude of fluctuation in at least one of a vacuum static pressure in the cleaner, said air flow rate and an electric current of the electric driven blower motor, and changes a control air flow rate lower limit value in accordance with a signal of said suction nozzle discriminating apparatus.

15. A vacuum cleaner according to claim 14, wherein said means for controlling the suction performance characteristic in response to a detected amount of said air flow rate from said detecting means changes the air flow rate so that it is in a range more than the lower limit value of said control air flow rate.

16. A vacuum cleaner adapted to selectively exchangeably accommodate a plurality of different types of suction nozzles, the vacuum cleaner comprising an air flow rate detecting means for detecting a suction air flow rate during a cleaning operation of the vacuum cleaner, means for controlling a suction performance characteristic of said vacuum cleaner by controlling an electric drive blower motor of the vacuum cleaner in dependence upon a detected amount of said air flow rate detected by said detecting means, and said control means including a suction nozzle discriminating apparatus for discriminating the type of suction nozzle accommodated on the vacuum cleaner and for setting respective ones of a plurality of upper limit values of said air flow rates and respective ones of a plurality of lower limit values of said flow rates in accordance with the discriminated type or suction nozzle accommodated on the vacuum cleaner and for reducing said suction performance characteristic when an air flow is greater than a set upper limit value or less than a set limit value for the type of suction nozzle accommodated on the vacuum cleaner.

17. A vacuum cleaner according to claim 16, wherein said suction nozzle discriminating apparatus discriminates the type of suction nozzle in dependence upon a magnitude of fluctuation in at least one of a vacuum static pressure in the cleaner, said air flow rate and an electric current of the electric driven blower motor, and changes a control air flow rate upper limit value in accordance with a signal of said suction nozzle discriminating apparatus.

18. A vacuum cleaner according to claim 17, wherein said means for controlling the suction performance characteristic in response to said detected amount said air flow rate detected by said detecting means changes the air flow rate so that it is in a range less than the upper limit value of said control air flow rate.

* * * * *